US010926562B2

(12) United States Patent
Eto

(10) Patent No.: US 10,926,562 B2
(45) Date of Patent: Feb. 23, 2021

(54) JOINT MECHANISM AND LIQUID EJECTION DEVICE INCLUDING THE SAME

(71) Applicant: KYOCERA Document Solutions Inc., Osaka (JP)

(72) Inventor: Daisuke Eto, Osaka (JP)

(73) Assignee: KYOCERA Document Solutions Inc.

( * ) Notice: Subject to any disclaimer, the term of this patent is extended or adjusted under 35 U.S.C. 154(b) by 0 days.

(21) Appl. No.: 16/709,989

(22) Filed: Dec. 11, 2019

(65) Prior Publication Data

US 2020/0189301 A1 Jun. 18, 2020

(30) Foreign Application Priority Data

Dec. 12, 2018 (JP) ..... JP2018-232899

(51) Int. Cl.
*B41J 29/38* (2006.01)

(52) U.S. Cl.
CPC ..... *B41J 29/38* (2013.01)

(58) Field of Classification Search
CPC ..... B41J 29/38
See application file for complete search history.

(56) References Cited

U.S. PATENT DOCUMENTS

2008/0152388 A1* 6/2008 Ueno ..... G03G 15/751 399/167
2011/0141192 A1* 6/2011 Komuro ..... B41J 23/025 347/37
2018/0128381 A1* 5/2018 Schmitt ..... F16K 31/041

FOREIGN PATENT DOCUMENTS

JP 2004-51255 2/2004

* cited by examiner

*Primary Examiner* — Scott A Richmond
(74) *Attorney, Agent, or Firm* — Gerald E. Hespos; Michael J. Porco; Matthew T. Hespos

(57) ABSTRACT

Provided is a joint mechanism where a rotational drive force of a drive shaft is transmitted to a driven shaft. The joint mechanism includes a first engaging portion, a second engaging portion which is engageable with the first engaging portion, a coupling, a first distal end portion, and a second distal end portion. The coupling has the second engaging portion, and is swingable in a direction intersecting with the axial direction in a state where the second engaging portion is engaged with the first engaging portion. The first distal end portion is a distal end portion of the driven shaft, and the first engaging portion or the coupling is mounted on the first distal end portion. The second distal end portion is a distal end portion of the drive shaft, and the coupling or the first engaging portion is mounted on the second distal end portion.

3 Claims, 26 Drawing Sheets

JOINT MECHANISM AND LIQUID EJECTION DEVICE INCLUDING THE SAME

INCORPORATION BY REFERENCE

This application is based on Japanese Patent Application No. 2018-232899 filed with the Japan Patent Office on Dec. 12, 2018, the contents of which are hereby incorporated by reference.

BACKGROUND

Field of the Invention

The present disclosure relates to a joint mechanism and a liquid ejection device. To be more specific, the present disclosure relates to a joint mechanism where a driven shaft which is pivotally supported on a carriage provided to a liquid ejection device in a movable manner and a drive shaft which transmits a drive force to the driven shaft are coaxially connected to each other, and the liquid ejection device which includes the joint mechanism.

Related Art

As an image forming device such as an ink-jet printer which is a liquid ejection device, there has been known a device including a joint mechanism where a drive shaft which is rotatably driven by a drive force from a drive source and a driven shaft which is rotatably driven corresponding to the rotation of the drive shaft are coaxially connected to each other. As such a kind of joint mechanism, there has been known a configuration including an engaging pin and a coupling having an engaging recessed portion with which the engaging pin is engaged in a detachable manner.

In the above-mentioned conventional technique, the engaging pin is mounted on a distal end portion of the driven shaft, and the coupling is mounted on a distal end portion of the drive shaft. The driven shaft is pivotally supported on a movable body (paper feeding tray). On the movable body, an operation mechanism which is operated due to the rotation of the driven shaft is mounted. The engaging pin is inserted into the engaging recessed portion of the coupling along with the movement of the movable body which pivotally supports the driven shaft toward the drive shaft and hence, the engaging pin and the engaging recessed portion of the coupling are engaged with each other. With such a configuration, the drive shaft and the driven shaft are coaxially connected to each other, and a rotational drive force of the drive shaft can be transmitted to the driven shaft.

SUMMARY

According to an aspect of the present disclosure, there is provided a joint mechanism where a drive shaft which is rotatably driven by a drive force from a drive source and a driven shaft which is pivotally supported on a movable body are coaxially connected to each other along an axial direction, and a rotational drive force of the drive shaft is transmitted to the driven shaft. The joint mechanism includes a first engaging portion, a second engaging portion which is engageable with the first engaging portion, a coupling, a first distal end portion, and a second distal end portion. The coupling has the second engaging portion, and is swingable in a direction intersecting with the axial direction in a state where the second engaging portion is engaged with the first engaging portion. The first distal end portion is a distal end portion of the driven shaft, and the first engaging portion or the coupling is mounted on the first distal end portion. The second distal end portion is a distal end portion of the drive shaft, and the coupling or the first engaging portion is mounted on the second distal end portion.

According to another aspect of the present disclosure, there is provided a liquid ejection device including a drive shaft, a movable body, an operation mechanism, a head unit, and a joint mechanism. The drive shaft is rotatably driven by a drive force from the drive source. The movable body has a support portion which pivotally supports a driven shaft rotatably driven corresponding to the rotation of the drive shaft, and is movable in a direction intersecting with an axial direction of the drive shaft. The operation mechanism is mounted on the movable body, and is operated by the rotation of the driven shaft. The head unit is mounted on the movable body and is capable of ejecting a predetermined liquid corresponding to an operation of the operation mechanism. The joint mechanism is the above-mentioned joint mechanism where the drive shaft and the driven shaft are coaxially connected to each other along the axial direction.

DETAILED DESCRIPTION

[Overall Configuration of Printer]

Figure 1:
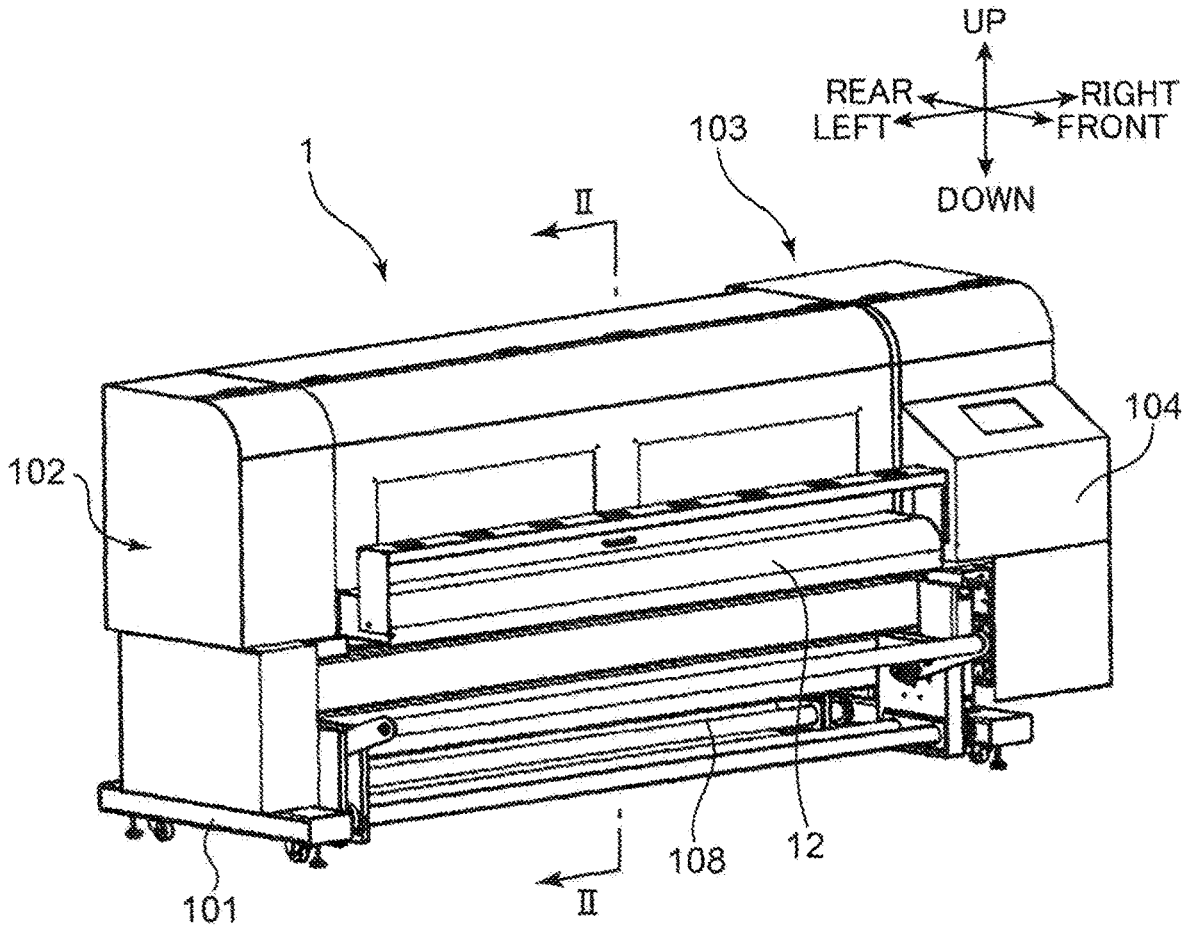
FIG. 1 is a perspective view showing an external appearance of an ink jet printer to which the present disclosure is applied.
Figure 2:
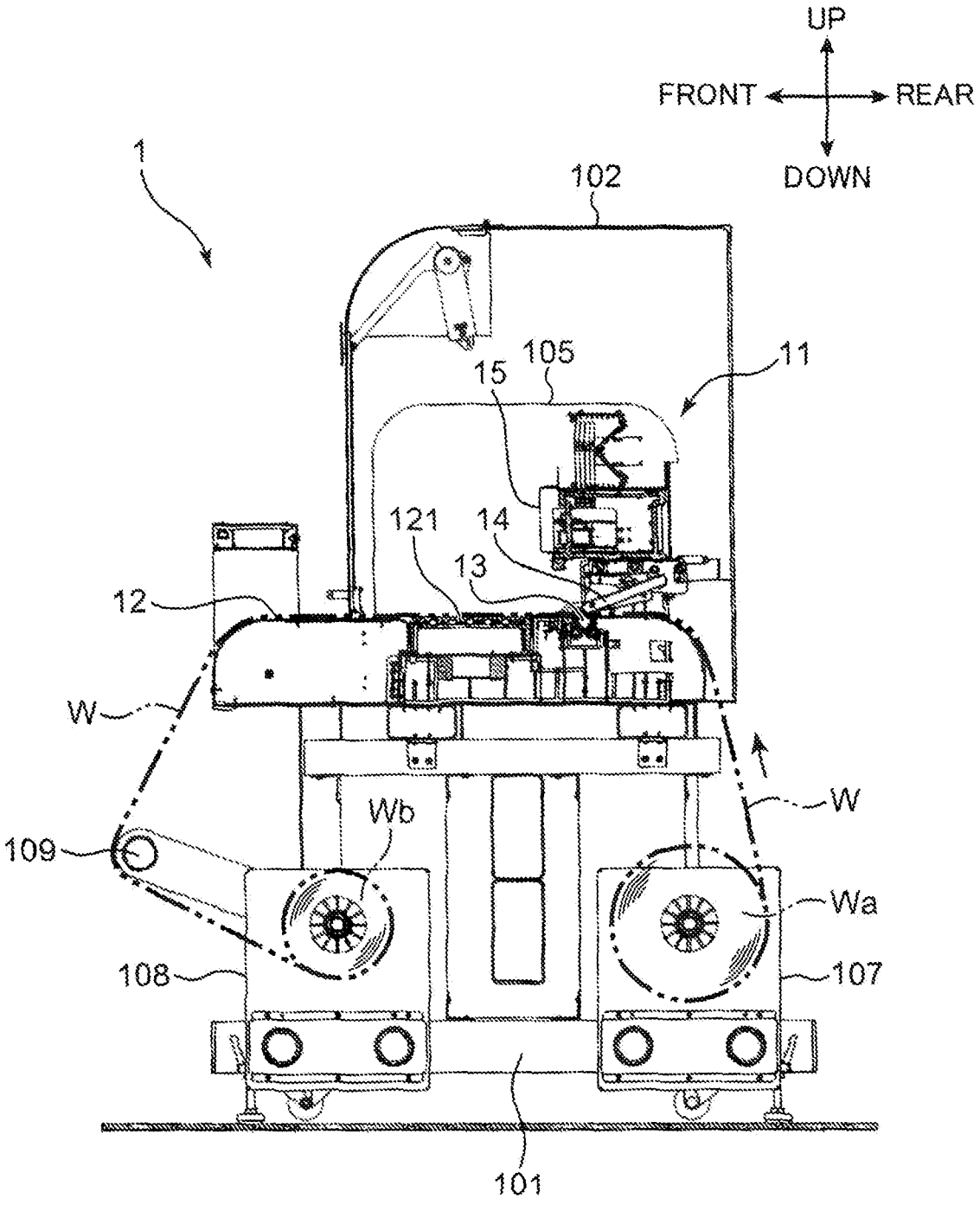
FIG. 2 is a sectional view along line II-II in FIG. 1.
Figure 3:
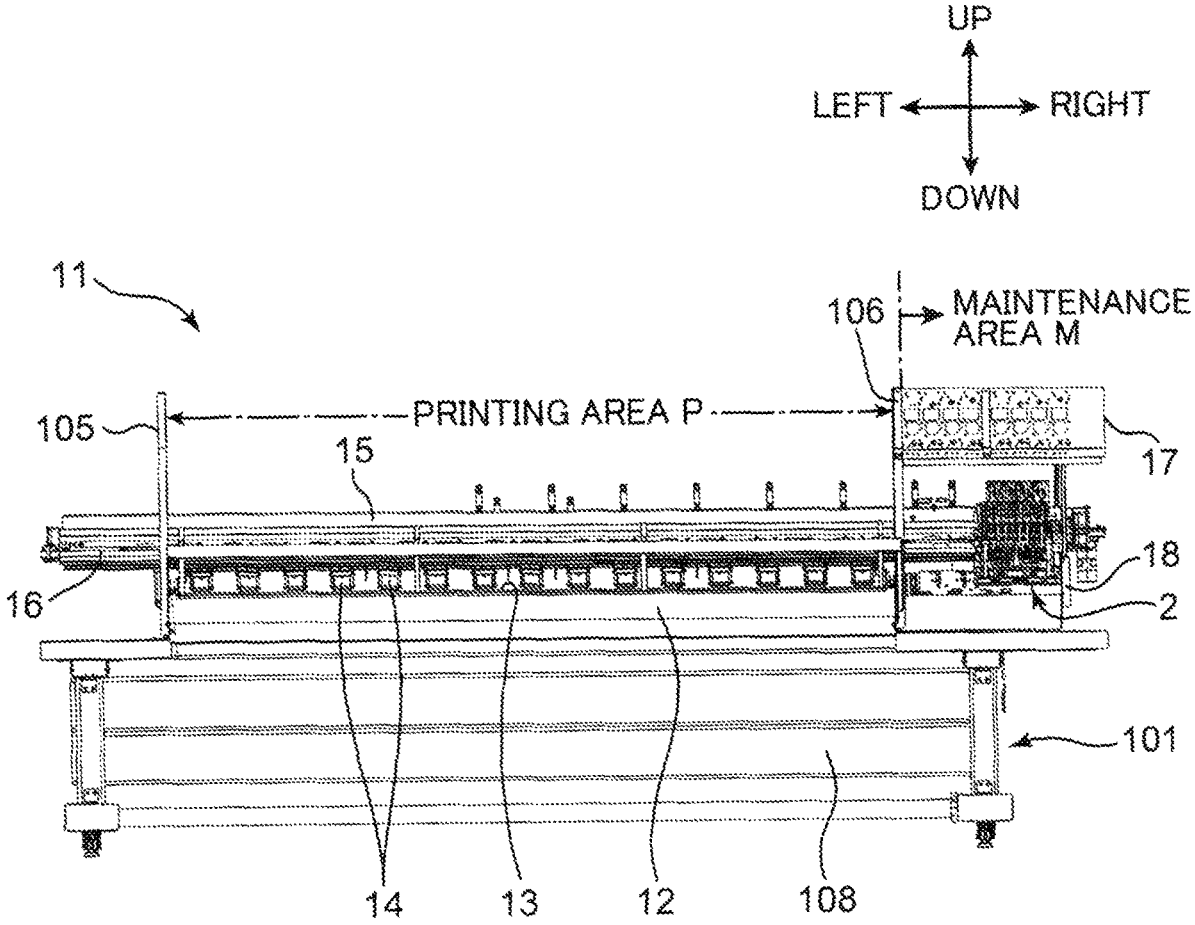
FIG. 3 is a front view of the ink jet printer with an outer cover removed.

Hereinafter, one embodiment of the present disclosure is described with reference to the drawings. First, an ink jet printer to which a liquid ejection device according to the present disclosure is applied is described. FIG. 1 is a perspective view showing the external appearance of an ink ejecting printer 1 according to the embodiment, FIG. 2 is a sectional view along line II-II of FIG. 1, and FIG. 3 is a front view of the printer 1 with an outer cover 102 removed. Note that front-rear, lateral and vertical directions are indicated in FIGS. 1 to 3 and figures described later, but this is only for the convenience of description and not intended to limit directions at all.

The printer 1 (liquid ejection device) is a printer for performing a printing process of printing characters and images on various works W such as paper sheets, resin sheets or cloth fabrics of various sizes by an ink ejecting method, and particularly a printer suitable for a printing process on large-size and long works. The printer 1 includes: a base frame 101 with casters; and an apparatus body 11 placed on this base frame 101 and configured to perform the printing process.

The apparatus body 11 includes a work conveyance path 12, a conveyor roller 13, pinch roller units 14 and a carriage 2. The work conveyance path 12 is a conveyance path extending in a front-rear direction for loading a work W, to which the printing process is applied, into the apparatus body 11 from a rear side and unloading the work W from a front side. The conveyor roller 13 is a roller extending in a lateral direction and configured to generate a drive force for intermittently feeding the work W along the work conveyance path 12. The pinch roller unit 14 is arranged to face the conveyor roller 13 from above and includes a pinch roller which forms a conveyance nip together with the conveyor roller 13. A plurality of the pinch roller units 14 are arranged at predetermined intervals in the lateral direction.

The carriage 2 is a movable body on which units for performing the printing process on the work W are mounted and which can reciprocate along the lateral direction on the base frame 101. A carriage guide 15 with a guide rail for guiding reciprocal movements of the carriage 2 stands to extend in the lateral direction on a rear side of the base frame 101. A timing belt 16 is so assembled with the carriage guide 15 as to be able to circulate in the lateral direction. The carriage 2 includes a fixing portion for the timing belt 16, and moves in the lateral direction while being guided by the guide rail as the timing belt 16 circulates in a forward or reverse direction.

The printing process is performed by intermittently feeding the work W by the conveyor roller 13 and the pinch roller units 14 and moving the carriage 2 in the lateral direction while the work W is stopped to print and scan the work W (eject ink to the work W). Note that, in the work conveyance path 12, a platen 121 (see FIG. 2) additionally provided with a function of sucking the work W is arranged below a passage path of the carriage 2. During the printing process, the carriage 2 performs printing and scanning with the work W sucked to the platen 121.

The apparatus body 11 is covered by the outer cover 102. A side station 103 is arranged in a region to the right of the outer cover 102. An immovable ink cartridge shelf 17 for holding ink cartridges IC (FIG. 5) for storing ink (predetermined liquid) for the printing process is housed in the side station 103.

A front part of the side station 103 is a carriage retraction area 104 serving as a retraction space for the carriage 2. As shown in FIG. 3, a left frame 105 and a right frame 106 stand on the base frame 101 while being spaced apart in the lateral direction by a distance corresponding to the work conveyance path 12. If classified as a work area, a region between these left and right frames 105, 106 serves as a printing area P where the printing process can be performed. The carriage guide 15 has a lateral width longer than the printing area P, and the carriage 2 is movable to a right outer side of the printing area P. A right end side of the carriage guide 15, i.e. a region to the right of and adjacent to the printing area P is a maintenance area M. When the printing process is not performed, the carriage 2 is retracted to the maintenance area M (carriage retraction area 104). Further, a pressurized purge process to be described later is also performed in this carriage retraction area 104.

A feeding unit 107 housing a feed roll Wa, which is a winding body of the work W to be subjected to the printing process, is provided on a rear side of the base frame 101. Further, a winding unit 108 housing a winding roll Wb, which is a winding body of the work W after the printing process, is provided on a front side of the base frame 101. The winding unit 108 includes an unillustrated drive source for rotationally driving a winding shaft of the winding roll Wb, and winds the work W while applying predetermined tension to the work W by a tension roller 109.

[Configuration of Carriage]

Figure 4:
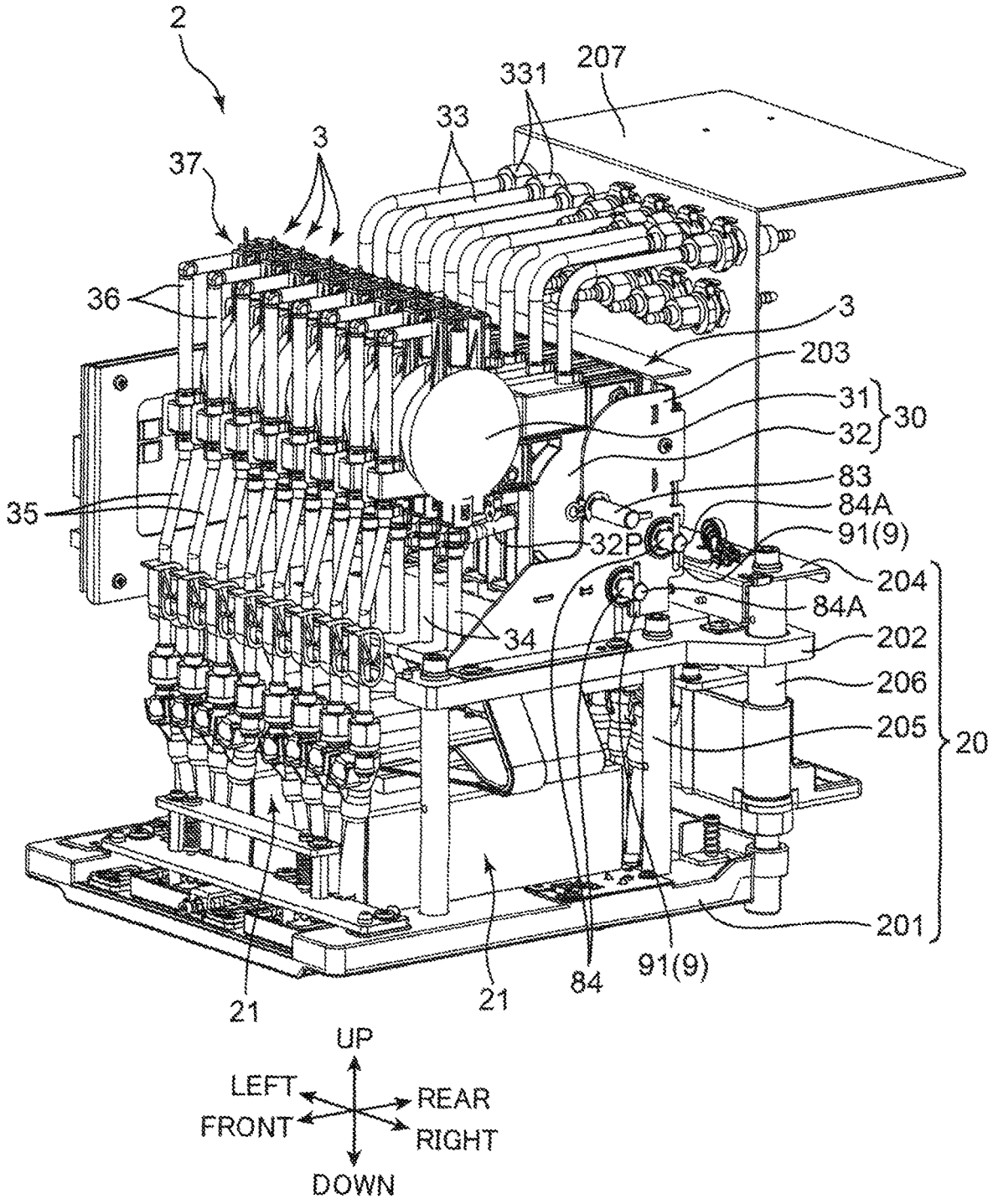
FIG. 4 is an overall perspective view of a carriage mounted in the ink jet printer.

FIG. 4 is an overall perspective view of the carriage 2. Head units 21 for ejecting the ink to the work W and liquid supply units 3 for supplying the ink from the ink cartridges IC (FIG. 5) to the head units 21 are mounted on the carriage 2. FIG. 4 shows an example in which two head units 21 and eight liquid supply units 3 are mounted on the carriage 2. Specifically, four liquid supply units 3 are equipped for each head unit 21 to supply respective inks of cyan, magenta, yellow and black. Note that the ink of a different color is filled into each liquid supply unit 3, and inks of at most eight colors may be ejected from the two head units 21.

The carriage 2 includes the head units 21 and a carriage frame 20 for holding the head units 21. The carriage frame 20 includes a lower frame 201 located at a lowermost position, an upper frame 202 arranged above and at a distance from the lower frame 201, a rack 203 mounted on the upper surface of the upper frame 202 and a back surface frame 204 mounted on the rear surface of the upper frame 202. The lower frame 201 and the upper frame 202 are coupled by coupling support columns 205 extending in the vertical direction. An unillustrated ball screw mechanism is mounted on the back surface frame 204, and a nut portion driven by that ball screw is mounted on the lower frame 201. Further, the back surface frame 204 is provided with guiding support columns 206 extending in the vertical direction. By the drive of the ball screw mechanism, a coupled body of the lower frame 201 and the upper frame 202 can move in the vertical direction while being guided by the guiding support columns 206. That is, a body part of the carriage 2 is movable in the vertical direction with respect to the back surface frame 204. Further, a back surface plate 207 on which upstream ends 331 of upstream pipes 33 are mounted stands on the back surface frame 204.

The head units 21 are mounted on the lower frame 201. Since the body part of the carriage 2 is movable in the vertical direction as described above, vertical height positions of the head units 21 with respect to the work W are adjustable. The liquid supply units 3 are mounted on the upper frame 202. The eight liquid supply units 3 are supported on the upper frame 202 while being aligned in the lateral direction in the rack 203. A guided portion to be guided by the guide rail of the carriage guide 15, a fixing portion to the timing belt 16 and the like are provided on the back surface frame 204.

Figure 5:
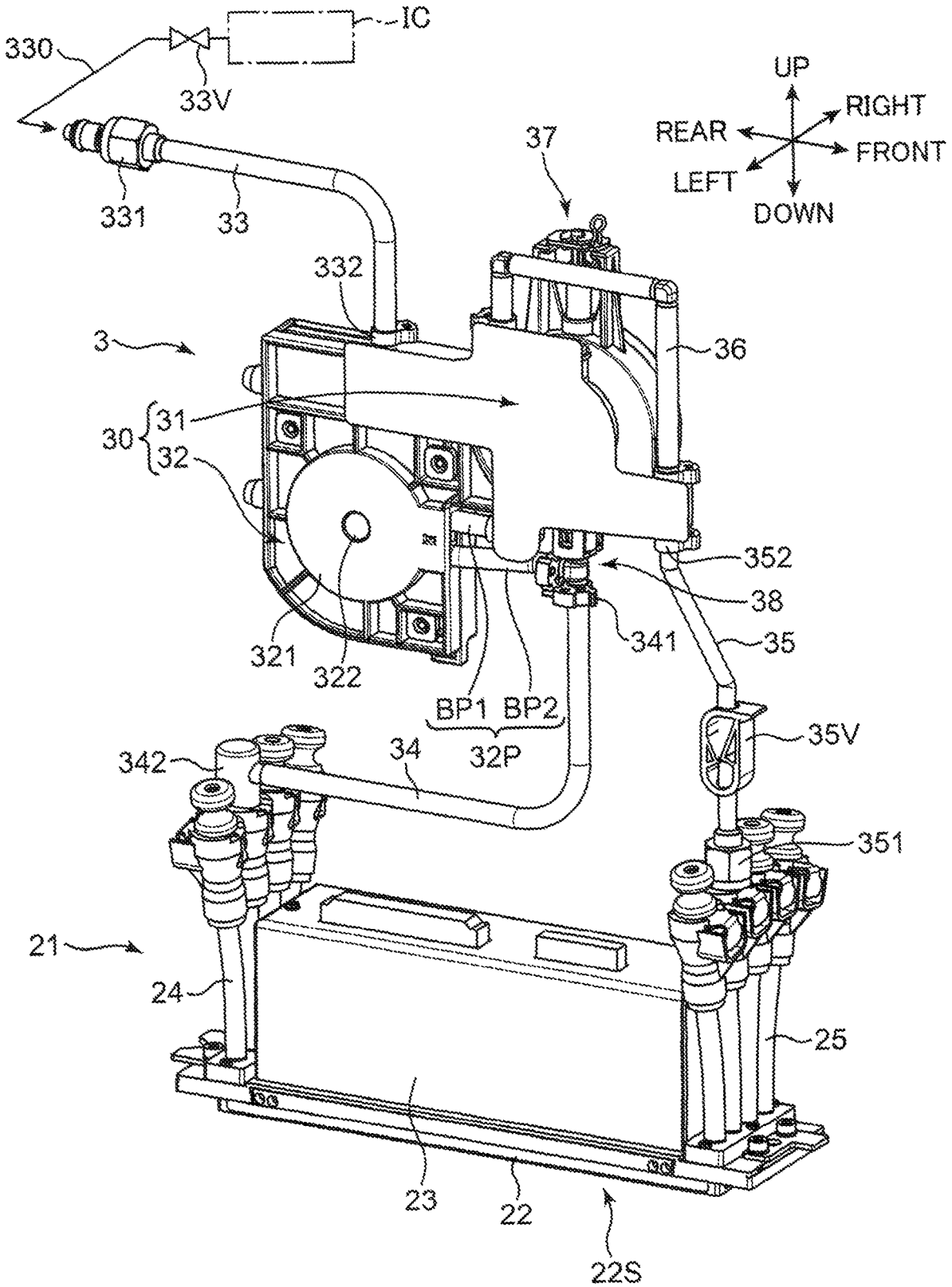
FIG. 5 is a perspective view showing one liquid supply unit and one head unit.

FIG. 5 is a perspective view showing one liquid supply unit 3 and one head unit 21. The liquid supply unit 3 includes a body portion 30 with a tank portion 31 and a pump portion 32, the upstream pipe 33 arranged on an upstream side of the body portion 30 in an ink supply direction, a downstream pipe 34 arranged on a downstream side of the body portion 30, a return pipe 35 serving as a path for returning the ink from the side of the head unit 21 to the side of the liquid supply unit 3, a monitor pipe 36 and a bypass pipe 32P.

The tank portion 31 is a region forming a space for temporarily storing the ink to be supplied to the head unit 21 under a negative pressure environment. The pump portion 32 is a region for housing a pump 8 (FIGS. 7 to 10) to be operated during a decompression process for forming the negative pressure environment, a pressurized purge process for cleaning the head unit 21 (ink ejecting portion 22) and a circulation process for circulating the ink between the head unit 21 and the liquid supply unit 3.

The upstream pipe 33 is a supply pipe allowing communication between the tank portion 31 (second chamber 42) and the ink cartridge IC. The upstream end 331 of the upstream pipe 33 is connected to a terminal end part of a tube 330 extending from the ink cartridge IC, and a downstream end 332 is connected to an inlet part of the tank portion 31. A supply valve 33V functioning to open and close the upstream pipe 33 is mounted in the tube 330. When the supply valve 33V is opened, the ink can be supplied from the ink cartridge IC to the tank portion 31. When the supply valve 33V is closed, the supply cannot be made.

The downstream pipe 34 is a supply pipe allowing communication between the tank portion 31 (second chamber 42) and the head unit 21. An upstream end 341 of the downstream pipe 34 is connected to an outlet part of the tank portion 31 via a backflow prevention mechanism 38 and a downstream end 342 is connected to the head unit 21. The return pipe 35 is a pipe allowing communication between the head unit 21 and the tank portion 31 (second chamber 42). An upstream end 351 of the return pipe 35 is connected to the head unit 21, and a downstream end 352 is connected to the tank portion 31. A clip 35V for opening and closing the return pipe 35 is mounted on the return pipe 35. FIG. 5 shows a state where the clip 35V squeezes the return pipe 35 to close the return pipe 35. The monitor pipe 36 is a pipe for indicating an ink level in the tank portion 31. The bypass pipe 32P is a conduit for feeding the ink to the downstream pipe 34 without via the negative pressure environment (second chamber 42) of the tank portion 31. The bypass pipe 32P includes an upstream bypass pipe BP1 arranged upstream of the pump portion 32 and a downstream bypass pipe BP2 arranged downstream of the pump portion 32.

The head unit 21 includes the ink ejecting portion 22, a control unit 23, an end tube 24 and a recovery tube 25. The ink ejecting portion 22 is a nozzle part for ejecting ink droplets toward the work W. A piezo method using a piezo element, a thermal method using a heating element or the like can be adopted as a method for ejecting ink droplets in the ink ejecting portion 22. The control unit 23 includes a control board for controlling the piezo element or the heating element provided in the ink ejecting portion 22 and controls an operation of ejecting ink droplets from the ink ejecting portion 22.

The end tube 24 is a tube linking the downstream end 342 of the downstream pipe 34 and the ink ejecting portion 22. The downstream end 342 is a cap-type socket and attachable to an upper end fitting part of the end tube 24 in a single operation. The recovery tube 25 is a tube linking the ink ejecting portion 22 and the upstream end 351 of the return pipe 35. Note that the recovery tube 25 is used also to discharge a preservation solution sealed in the liquid supply unit 3 during initial usage. During initial usage, the downstream end 342 of the downstream pipe 34 is connected to the upper end fitting part of the end tube 24 and a separate tube is connected to the recovery tube 25 to release a storage space for the preservation solution, whereby an operation of discharging the preservation solution is performed.

Figure 6A:
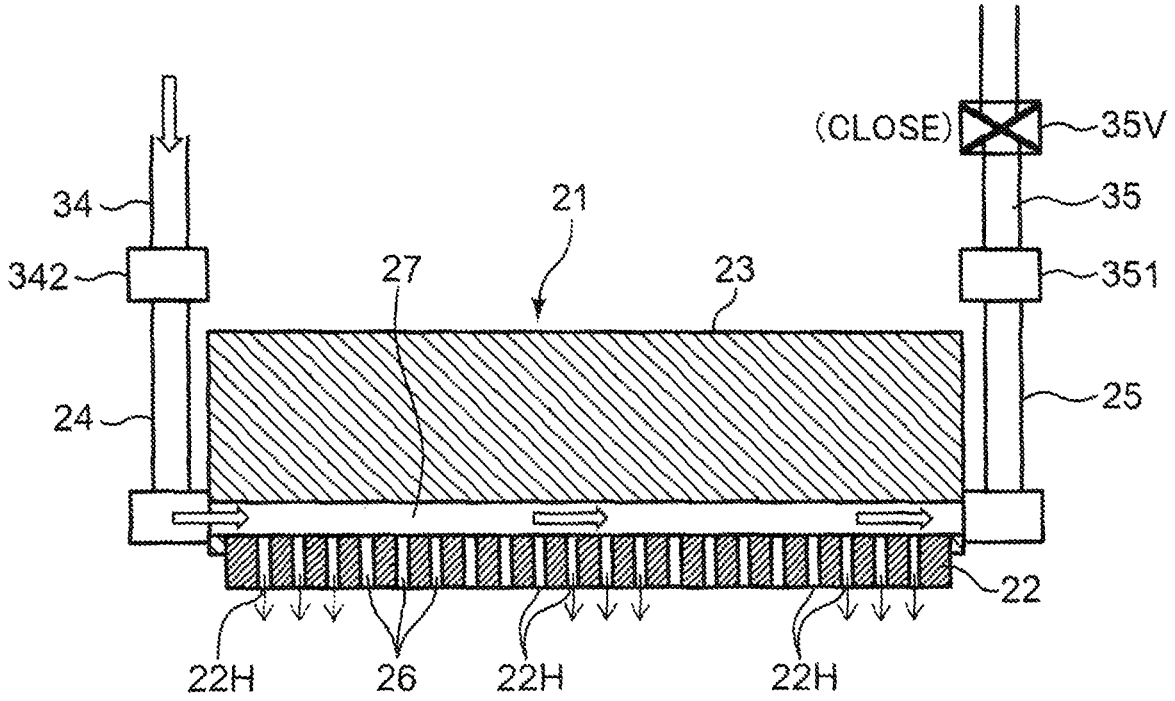
FIG. 6A is a view schematically showing a cross-section of the head unit in a front-rear direction, and showing a state where a print mode is being performed.
Figure 6B:
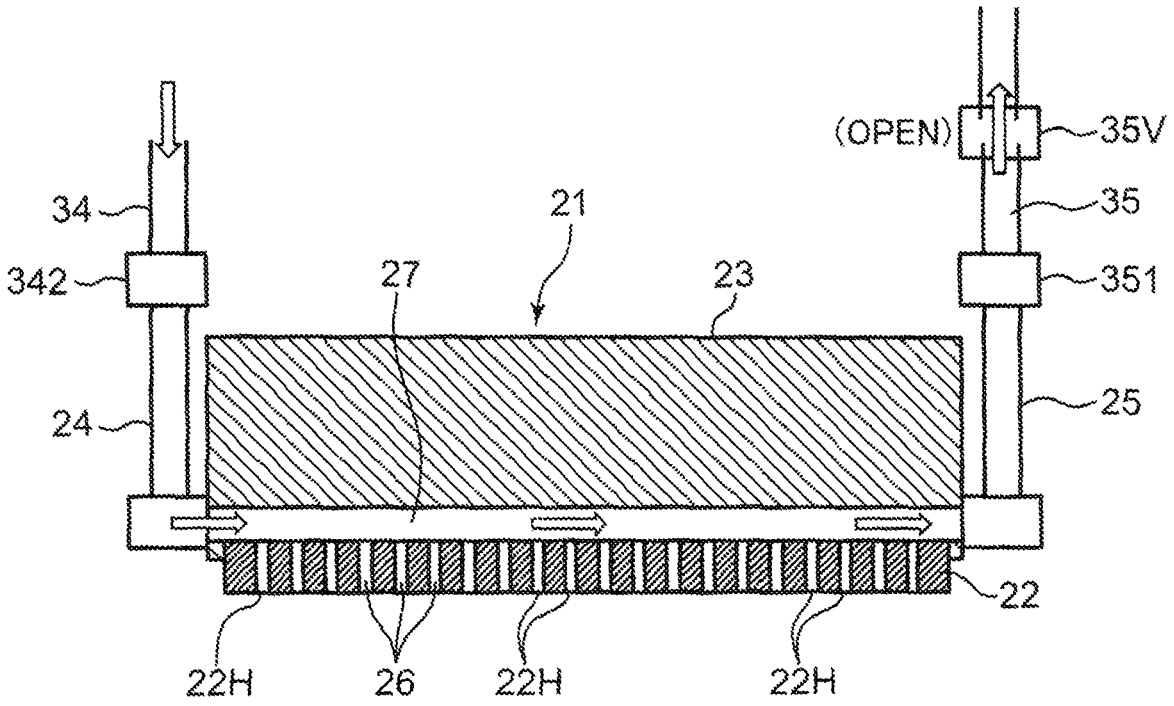
FIG. 6B is a view schematically showing a cross-section of the head unit in the front-rear direction, and showing a state where a circulation mode is being performed.

FIGS. 6A and 6B are views schematically showing a cross-section of the head unit 21 in the front-rear direction, wherein FIG. 6A shows a state where the clip 35V is closed (print mode) and FIG. 6B shows a state where the clip 35V is opened (circulation mode). The ink ejecting portion 22 includes a plurality of ink discharge holes 22H for ejecting the ink toward the work W. Individual passages 26 for individually supplying the ink to the ink discharge holes 22H and a common passage 27 for supplying the ink to these individual passages 26 are provided inside the head unit 21.

The common passage 27 is an ink passage extending in a horizontal direction. An upstream end of each individual passage 26 communicates with the common passage 27. The downstream end 342 of the downstream pipe 34 communicates with an upstream side of the common passage 27 via the end tube 24. The upstream end 351 of the return pipe 35 communicates with a downstream side of the common passage 27 via the recovery tube 25. In other words, the upstream side and the downstream side of the common passage 27 communicate with the tank portion 31 (second chamber 42) respectively through the downstream pipe 34 and the return pipe 35.

As shown in FIG. 6A, assume that the ink is supplied to the head unit 21 from the downstream pipe 34 in a state where the return pipe 35 is closed by the clip 35V. In this case, the ink is discharged from the ink discharge holes 22H through the common passage 27 and the respective individual passages 26. On the other hand, as shown in FIG. 6B, assume a case where the ink is supplied from the downstream pipe 34 to the head unit 21 in a state where the clip 35V is released so that the return pipe 35 is opened. In this case, the ink returns to the tank portion 31 mainly through the return pipe 35. In this case, if the return pipe 35 is set to a negative pressure, the ink does not leak from the ink discharge holes 22H.

[Configuration of Liquid Supply System]

In this embodiment, the device is configured such that the ink cartridge IC is arranged above the head unit 21 and the ink is supplied to the head unit 21 by a water head difference. In the case of supplying the ink by the water head difference, the ink is constantly ejected from the ink ejecting portion 22 of the head unit 21 if the ink is supplied at normal pressure. Thus, it is necessary to dispose a negative pressure generating portion for generating a negative pressure environment in the ink supply passage and set the ink ejecting portion 22 to a suitable negative pressure. The tank portion 31 of the liquid supply unit 3 functions as the above negative pressure generating portion.

Figure 7:
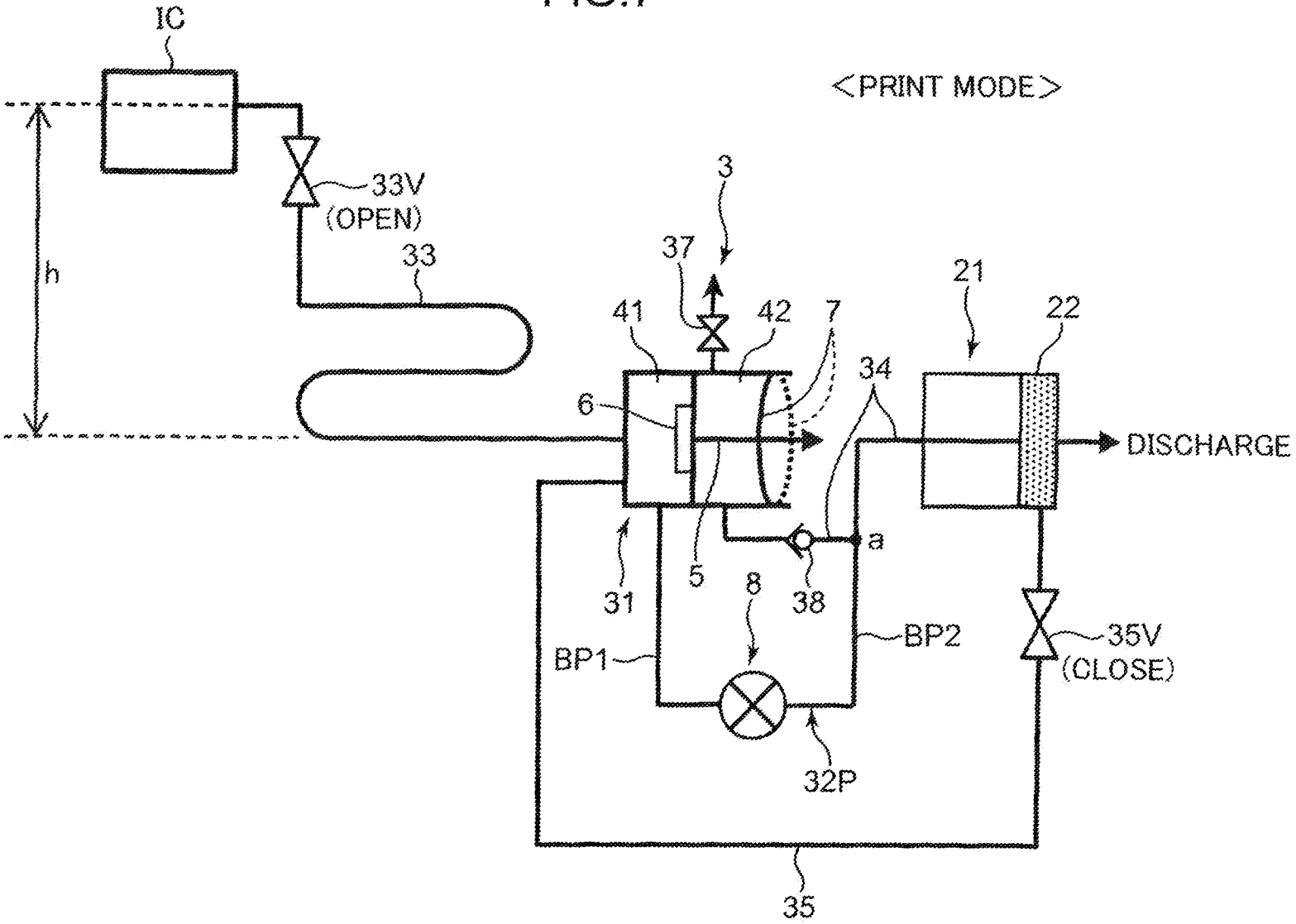
FIG. 7 is a block diagram of a liquid supply system in an embodiment showing the state where the print mode is being performed.

FIG. 7 is a block diagram schematically showing the liquid supply system adopted in the carriage 2 of this embodiment. The ink cartridge IC is arranged at a position higher than the ink ejecting portion 22 by a height h. This height h serves as the water head difference and the ink in the ink cartridge IC is supplied to the head unit 21 by this water head difference. The liquid supply unit 3 is incorporated at an intermediate position of the ink supply passage between the ink cartridge IC and the head unit 21. The tank portion 31 of the liquid supply unit 3 includes a first chamber 41 set to a pressure higher than an atmospheric pressure by receiving the water head difference and the second chamber 42 arranged downstream of the first chamber 41 in the ink supply direction and set to a negative pressure. The first chamber 41 is a chamber in which a negative pressure operation is not performed and to which a pressure P by the water head difference is applied in addition to the atmospheric pressure. This pressure P is expressed by $P=\mu gh$ [Pa] when p denotes water density (ink can be handled equivalent to water in density), g denotes a gravitational acceleration and h denotes the water head difference. The first chamber 41 communicates with the ink cartridge IC via the upstream pipe 33. The second chamber 42 communicates with the ink ejecting portion 22 via the downstream pipe 34.

An on-off valve 6 coupled to a pressing member 5 is arranged on a wall member partitioning between the first chamber 41 and the second chamber 42. Further, a wall portion defining the second chamber 42 is partially constituted by an atmospheric pressure detection film 7. When a pressure in the second chamber 42 reaches a negative pressure exceeding a predetermined threshold value, the atmospheric pressure detection film 7 detects the atmospheric pressure to be displaced. This displacement force is applied to the pressing member 5, a posture of the coupled on-off valve 6 changes from a closing posture to an opening posture, and the first chamber 41 and the second chamber 42 are allowed to communicate. An ink supply route during a normal printing process is a route passing through the upstream pipe 33, the first chamber 41, the second chamber 42 and the downstream pipe 34. In addition to this, the bypass pipe 32P for short-circuiting the first chamber 41 and the downstream pipe 34 without via the second chamber 42 is provided. The upstream end of the bypass pipe 32P is connected to the upstream pipe 33 via the first chamber 41 and the downstream end joins the downstream pipe 34 (joint part a). The pump 8 capable of rotating in forward and reverse directions is arranged in the bypass pipe 32P.

FIG. 7 is also a diagram showing a state where the liquid supply system is performing the print mode for performing the printing process. In this print mode, the supply valve 33V of the upstream pipe 33 is opened, whereas the clip 35V of the return pipe 35 is closed. Further, in the print mode, a predetermined mount of the ink is filled in the first chamber 41 and the second chamber 42, and the second chamber 42 is set to a predetermined negative pressure. The pressure in the first chamber 41 is an atmospheric pressure+ρgh [Pa] by the water head difference as described above, so that the ink can be supplied from the ink cartridge IC by the water head difference any time. As basic settings of the print mode, the on-off valve 6 is set in the closing posture to set the second chamber 42 to a negative pressure, and the first chamber 41 and the second chamber 42 are isolated. The pump 8 is set in a stopped state. The pump 8 is a tube pump and the bypass pipe 32P is closed when the pump 8 is stopped. Thus, the downstream pipe 34 and the ink ejecting portion 22 are also maintained at a negative pressure.

To smoothly fill the ink into the second chamber 42, an air vent mechanism 37 is attached to the second chamber 42. A predetermined amount of the ink needs to be initially filled into the second chamber 42 during initial usage, after maintenance and the like. The air vent mechanism 37 promotes the initial filling by allowing the second chamber 42 set in the negative pressure environment to temporarily communicate with the atmosphere (by venting air in the second chamber 42). Further, the ink stored in the second chamber 42 may generate air bubbles by heating. The air vent mechanism 37 is also used in removing air based on the air bubbles from the second chamber 42.

When the head unit 21 operates and the ink ejecting portion 22 discharges ink droplets, the ink in the second chamber 42 is consumed and, accordingly, a degree of the negative pressure in the second chamber 42 progresses. That is, the ink ejecting portion 22 sucks the ink from the second chamber 42 in a state separated from the atmosphere and enhances a negative pressure degree of the second chamber 42 every time ejecting ink droplets. When the pressure in the second chamber 42 reaches a negative pressure exceeding the predetermined threshold value as the ink in the second chamber 42 decreases, the atmospheric pressure detection film 7 detects the atmospheric pressure to be displaced as described above. By this displacement force, the posture of the on-off valve 6 changes from the closing posture to the opening posture through the pressing member 5 and the first and second chambers 41, 42 communicate. Thus, the ink flows from the first chamber 41 into the second chamber 42 due to a pressure difference between the both chambers.

As the ink flows into the second chamber 42, the negative pressure degree of the second chamber 42 is gradually alleviated and approaches the atmospheric pressure. Simultaneously, the displacement force applied to the pressing member 5 from the atmospheric pressure detection film 7 also becomes gradually smaller. When the pressure in the second chamber 42 reaches a negative pressure below the predetermined threshold value, the posture of the on-off valve 6 returns to the closing posture and the first and second chambers 41, 42 are separated again. At this time, the ink is replenished into the first chamber 41 from the ink cartridge IC by the water head difference by an amount flowed into the second chamber 42 from the first chamber 41. In the print mode, such an operation is repeated.

The liquid supply system of this embodiment is capable of performing the circulation mode, the pressurized purge mode and a decompression mode in addition to the above print mode. The circulation mode is a mode for removing air trapped in the ink passage (individual passage 26, common passage 27) in the head unit 21 by circulating the ink using the return pipe 35. The pressurized purge mode is a mode for supplying high-pressure ink to the ink ejecting portion 22 and causing the ink ejecting portion 22 to eject the ink in order to recover or prevent ink clogging in the ink ejecting portion 22. The decompression mode is a mode for setting the second chamber 42 at normal pressure to the predetermined negative pressure during initial usage, after maintenance and the like.

Figure 8:
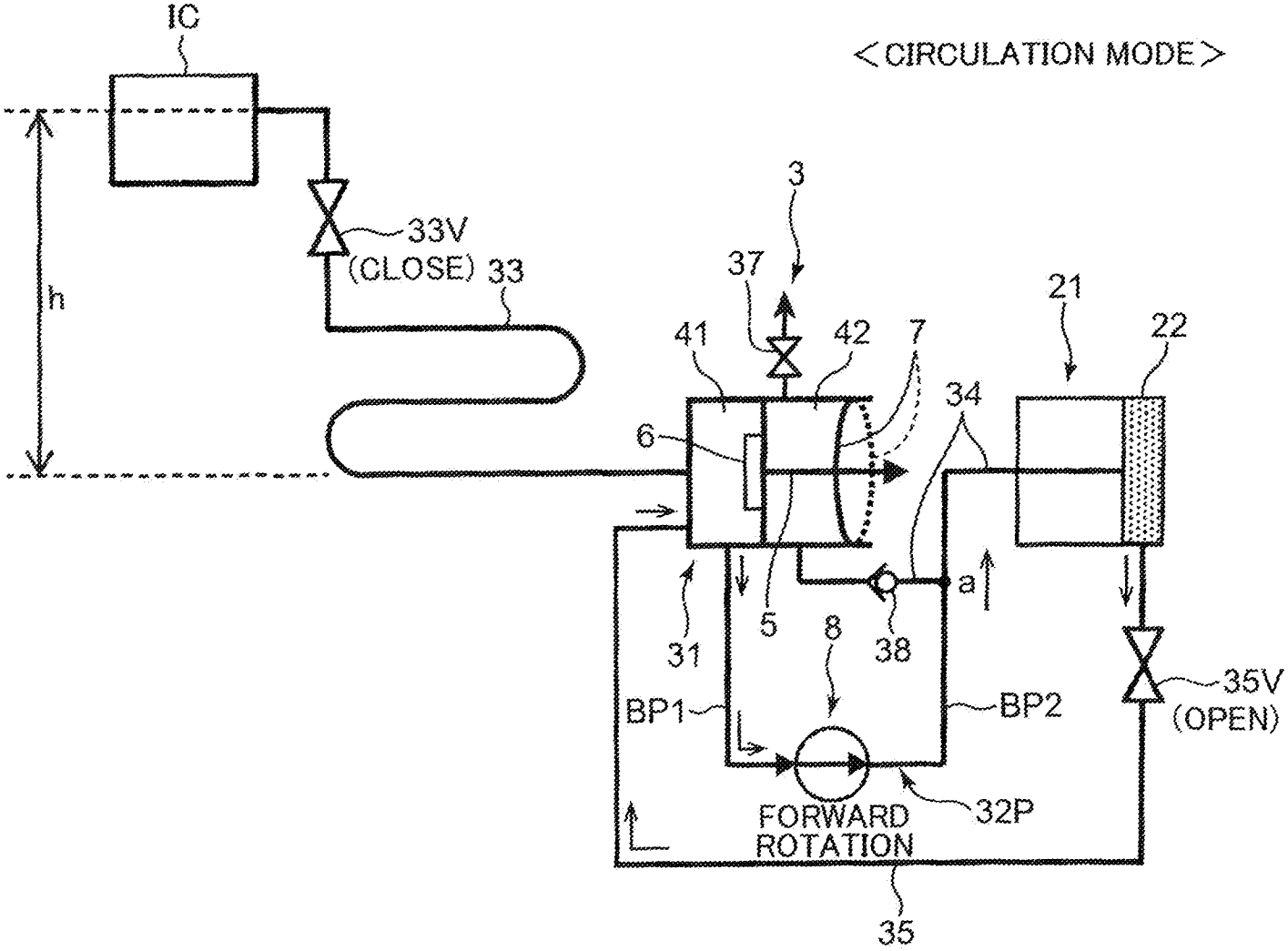
FIG. 8 is a block diagram showing the state where the circulation mode is being performed.

FIG. 8 is a block diagram showing the state where the circulation mode is being performed. In this circulation mode, the supply valve 33V is closed to close the upstream pipe 33, whereas the clip 35V is opened to open the return pipe 35. Further, the pump 8 arranged in the bypass pipe 32P is driven in the forward rotation direction. As shown in FIGS. 6A and 6B, the upstream end 351 of the return pipe 35 communicates with the downstream end of the common passage 27 in the head unit 21. On the other hand, the downstream end 352 of the return pipe 35 communicates with the first chamber 41. Further, the downstream end 352 of the return pipe 35 also communicates with the second chamber 42 via the first chamber 41 that directly communicates with the return pipe 35 and the on-off valve 6.

If the pump 8 is driven in the forward rotation direction in the circulation mode, the ink is circulated through a circulation path composed of the downstream bypass pipe BP2, a part of the downstream pipe 34 downstream of the joint part a, the common passage 27 in the head unit 21, the return pipe 35 and the upstream bypass pipe BP1. At this time, since the supply valve 33V is closed, the return pipe 35 and the common passage 27 are set to a negative pressure by an ink sucking operation of the pump 8. Accordingly, the ink does not leak from the ink discharge holes 22H. By performing the circulation mode, air taken into the head unit 21 can be recovered to the liquid supply unit 3 (first chamber 41). In this way, air can be prevented from staying in the individual passages 26 and the ink discharge holes 22H and an ink discharge failure can be suppressed. Note that the air recovered to the first chamber 41 can be transferred to the second chamber 42 through the on-off valve 6. Then, this air is released to outside by the air vent mechanism 37.

Figure 9:
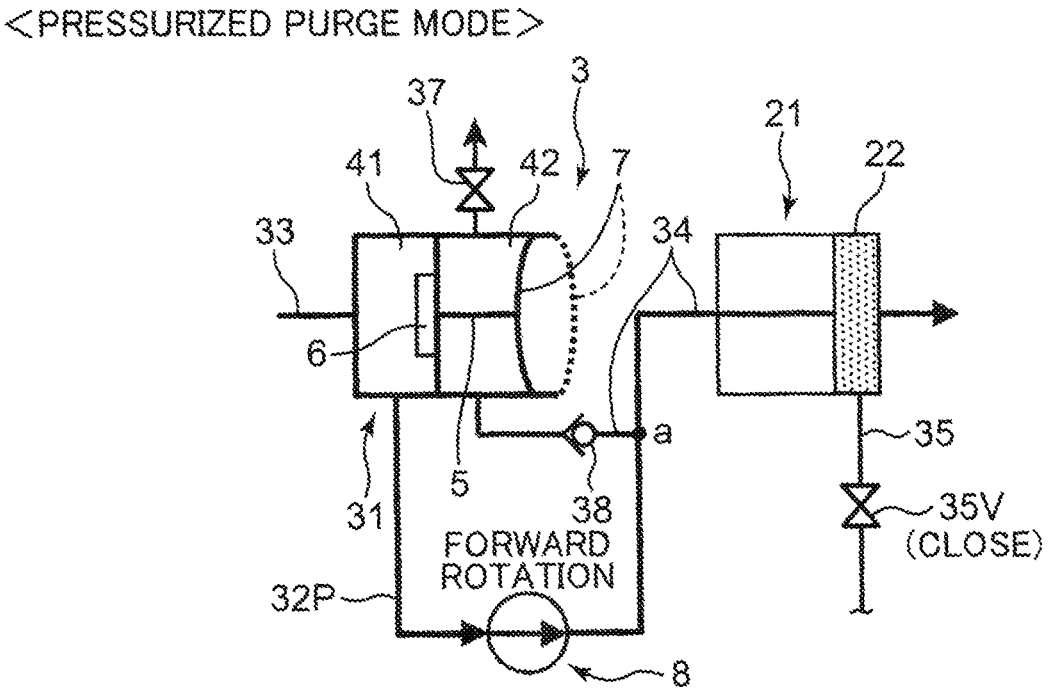
FIG. 9 is a block diagram showing a state where a pressurized purge mode is being performed.

FIG. 9 is a diagram showing a state where the pressurized purge mode is being performed. In the pressurized purge mode, the pump 8 is driven in the forward rotation direction. The clip 35V is closed. By the forward drive of the pump 8, the ink directly moves from the upstream pipe 33 toward the downstream pipe 34 via the first chamber 41 and the bypass pipe 32P while bypassing the second chamber 42. That is, the ink pressurized in the pump 8 is supplied to the ink ejecting portion 22. In this way, the ink is forcibly discharged from the ink ejecting portion 22 to clean the ink ejecting portion 22. Note that an operation similar to that in the pressurized purge mode is also performed when the preservation solution sealed in the liquid supply unit 3 is discharged during initial usage.

The backflow prevention mechanism 38 is provided to prevent the pressurized ink from flowing back to the second chamber 42 through the downstream pipe 34 when the pressurized purge mode is performed. The backflow prevention mechanism 38 is arranged in the downstream pipe 34 on a side upstream of the joint part a of the downstream pipe 34 and the downstream end of the bypass pipe 32P. Since the side of the downstream pipe 34 upstream of the joint part a is closed by the backflow prevention mechanism 38, all the high-pressure ink generated in the bypass pipe 32P flows toward the ink ejecting portion 22. Thus, the breakage of the atmospheric pressure detection film 7 defining the second chamber 42 is prevented.

Figure 10:
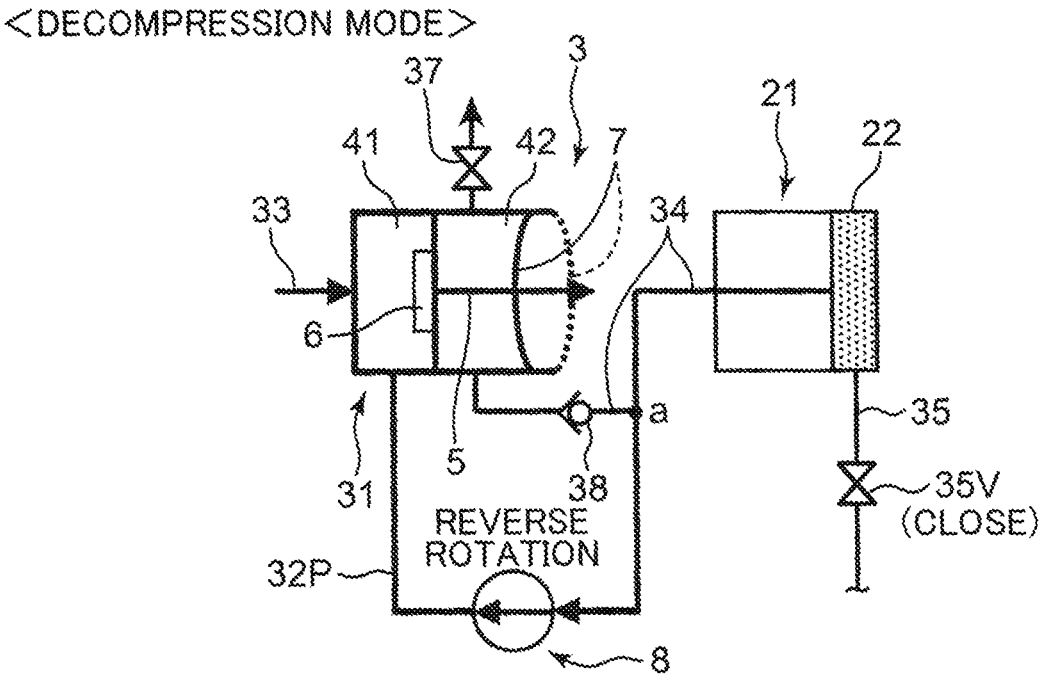
FIG. 10 is a block diagram showing a state where a decompression mode is being performed.

FIG. 10 is a diagram showing a state where the decompression mode is being performed. In the decompression mode, the pump 8 is driven in the reverse rotation direction. The clip 35V is closed. When the pump 8 is driven in the reverse rotation direction, the ink ejecting portion 22 and the second chamber 42 are decompressed through the downstream pipe 34 and the bypass pipe 32P. The ink ejecting portion 22 and the second chamber 42 are set to a predetermined negative pressure, i.e. a negative pressure at which ink droplets do not leak from the ink ejecting portion 22 even if the ink is supplied by the water head difference, by this decompression mode. Note that if the ink ejecting portion 22 is set to an excessive negative pressure, ink ejection by the drive of the piezo element or the like in the ink ejecting portion 22 may be impeded. Thus, the ink ejecting portion 22 and the second chamber 42 are desirably set, for example, to a weak negative pressure of about −0.2 to −0.7 kPa.

[Configuration of Pump Portion]

Figure 11:
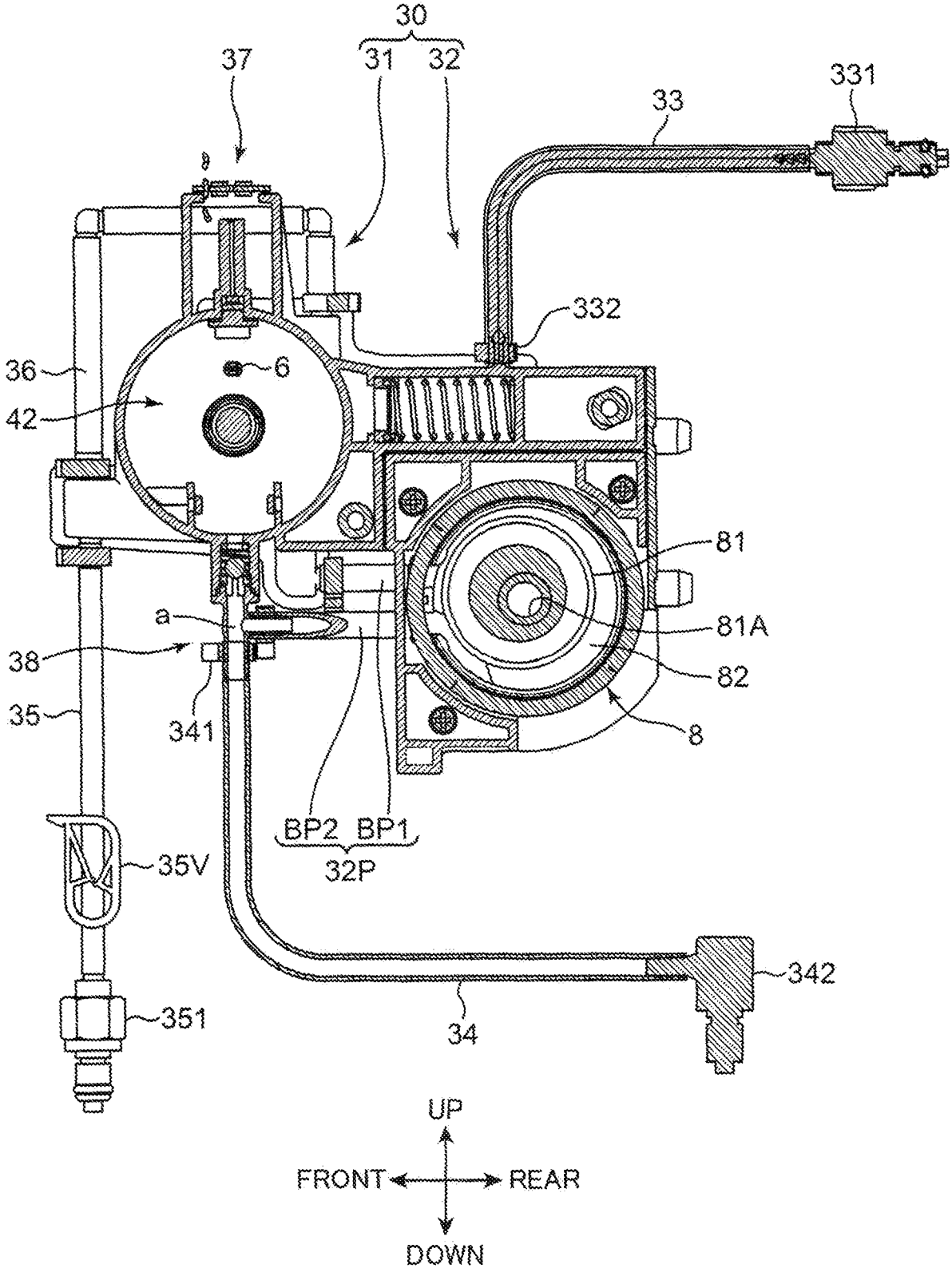
FIG. 11 is a sectional view of the liquid supply unit in a front-rear direction, and is a view showing an internal structure of a pump portion.

The configuration of the pump portion 32 is described with reference to FIG. 11 in addition to FIGS. 4 and 5. FIG. 11 is a sectional view of the liquid supply unit 3 in a front-rear direction, and is a view showing an internal structure of the pump portion 32. The pump portion 32 is disposed behind and obliquely below the tank portion 31 adjacently to the tank portion 31, and includes a pump cavity 321 and a cam shaft insertion hole 322. The pump cavity 321 is a cavity for storing the pump 8. The cam shaft insertion hole 322 is a boss hole disposed at a position concentric with the pump cavity 321, and a cam shaft 83 (FIG. 4) which pivotally supports an eccentric cam 81 of the pump 8 is inserted into the cam shaft insertion hole 322. The cam shaft 83 is supported on a rack 203.

The pump 8 forms a purge mechanism which performs the pressurized purge mode (purge process) for ejecting the pressurized ink from the ink ejecting portion 22. The pump 8 functions also as a mechanism for performing the circulation mode and the decompression mode.

The pump 8 is arranged in the bypass pipe 32P and pressurizes the ink flowing in the bypass pipe 32P. The pump 8 is a tube pump including the eccentric cam 81 and a squeeze tube 82. The cam shaft 83 serving as a rotary shaft of the eccentric cam 81 is inserted into a shaft hole 81A of the eccentric cam 81. A rotational drive force is applied to this eccentric cam 81 from an unillustrated drive gear. The squeeze tube 82 is arranged on the peripheral surface of the eccentric cam 81 and squeezed by the rotation of the eccentric cam 81 around the cam shaft 83 to feed the ink in the tube from one end side toward the other end side. In this embodiment, the squeeze tube 82 is a tube integral with the bypass pipe 32P. That is, one end side of the squeeze tube 82 serves as the upstream bypass pipe BP1, the other end side of the squeeze tube 82 serves as the downstream bypass pipe BP2, and a central portion of the squeeze tube 82 serves as a squeezing portion arranged on the peripheral surface of the eccentric cam 81.

As described above, the pump 8 is brought into a stopped state in the print mode shown in FIG. 7. In this case, a rotational drive force is not applied to the eccentric cam 81 and hence, a state is brought about where the eccentric cam 81 squeezes the squeeze tube 82 and is stopped. With such an operation, the ink supply passage which passes the bypass pipe 32P is closed. On the other hand, in the circulation mode shown in FIG. 8 and the pressurized purge mode shown in FIG. 9, since a rotational drive force in the forward rotation direction is applied to the eccentric cam 81, the pump 8 is driven in the forward rotation direction. In FIG. 11, the forward rotation direction of the eccentric cam 81 is a counterclockwise direction. By this forward drive of the pump 8, the ink is sucked from the first chamber 41 through the upstream bypass pipe BP1 and flows toward the back-flow prevention mechanism 38, which is the joint part a, from the downstream bypass pipe BP2. In the decompression mode shown in FIG. 10, since a rotational drive force in the reverse rotation direction is applied to the eccentric cam 81, the pump 8 is driven in the reverse rotation direction. Due to such a reverse rotation drive of the pump 8, a pressure in the second chamber 42 and a pressure in the downstream pipe 34 are brought into a negative pressure through the bypass pipe 32P.

[Head Cleaning Mechanism]

As described above, in a state where the carriage 2 is disposed in the maintenance area M shown in FIG. 3, the pressurized purge mode is performed. In the pressurized purge mode, the pump 8 performs purge process for ejecting the pressurized ink from the ink ejecting portion 22 of the head unit 21. Due to the purge process, it is possible to release or prevent the occurrence of ink clogging in the head unit 21 thus enabling the normal ink ejection from the head unit 21. In the head unit 21 after performing the purge process, the ink and the like are adhered to an ink ejection surface 22S (FIG. 5) of the ink ejecting portion 22. The ink ejection surface 22S is formed in a rectangular shape extending in the front-rear direction while having a predetermined width in the lateral direction.

Figure 12:
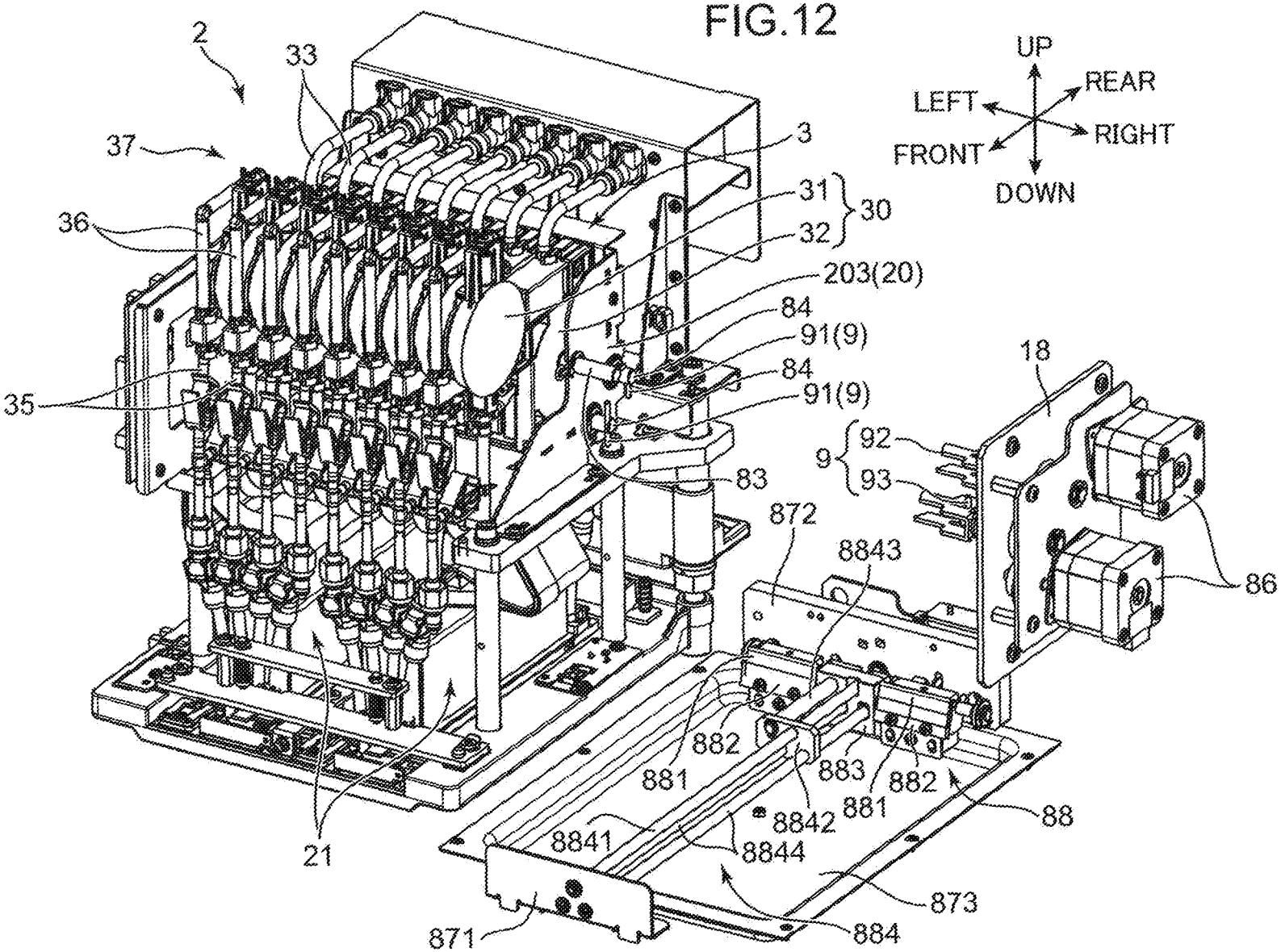
FIG. 12 is a perspective view showing configurations of a head cleaning mechanism and a joint mechanism disposed within a maintenance area.

The printer 1 according to this embodiment includes a head cleaning mechanism 88 shown in FIG. 12 as a mechanism for removing adhered substances such as the ink adhered to the ink ejection surface 22S. As shown in FIG. 12, the head cleaning mechanism 88 is disposed below the carriage 2 in the maintenance area M. The head cleaning mechanism 88 includes wiper blades 881, blade support plates 882, a movable body 883, and a blade moving portion 884. In this embodiment, corresponding to two head units 21, two wiper blades 881 and two blade support plates 882 are provided. The respective wiper blades 881 have the same configuration and the respective blade support plates 882 have the same configuration.

The wiper blade 881 is formed of a rubber-made blade member having a predetermined length in the lateral direction corresponding to a width of the ink ejection surface 22S. The wiper blade 881 is supported on the blade support plate 882, and the blade support plate 882 is fixedly mounted on the movable body 883. In other words, the wiper blade 881 is mounted on the movable body 883 in a state where the wiper blade 881 is supported on the blade support plate 882. The wiper blade 881 is disposed at a retracted position where the wiper blade 881 is retracted toward one side (rearward) in the front-rear direction with respect to the head unit 21 below the ink ejection surface 22S of the head unit 21.

FIG. 12 shows a state where the wiper blade 881 is disposed at the retracted position. The wiper blade 881 is movable in the front-rear direction along with the movement of the movable body 883 which moves in the front-rear direction by the blade moving portion 884 described later. The wiper blade 881 wipes the ink adhered to the ink ejection surface 22S by moving in the front-rear direction while being brought into contact with the ink ejection surface 22S using the retracted position as a start point after the purge process is performed by the pump 8.

The blade moving portion 884 is a mechanism for moving the wiper blade 881 by moving the movable body 883 in the front-rear direction. In this embodiment, the blade moving portion 884 is formed of a ball screw mechanism. The blade moving portion 884 includes a screw shaft 8841, a nut portion 8842, a connecting shaft 8843, and a guide shaft 8844.

The screw shaft 8841 is a shaft having an outer peripheral surface on which male threads are formed, and extending in the front-rear direction. The screw shaft 8841 penetrates the movable body 883, and is pivotally supported by a front plate 871 and a rear plate 872 in a rotatable manner. The screw shaft 8841 rotates in both the forward rotation direction and the reverse rotation direction about an axis of the screw shaft 8841. The front plate 871 and the rear plate 872 are plates which are disposed in a facing manner with a predetermined distance therebetween in the front-rear direction in the maintenance area M. Further, between the front plate 871 and the rear plate 872, below the wiper blade 881 and the blade moving portion 884, a waste liquid tray 873 which receives the ink ejected from the head unit 21 by the purge process is disposed.

The nut portion 8842 is a member on which female threads threadedly engageable with the male threads of the screw shaft 8841 are formed. The nut portion 8842 moves in the front-rear direction along the screw shaft 8841 along with the rotation of the screw shaft 8841 due to the threadedly engagement between the female threads and the male threads. The movement of the nut portion 8842 is guided by the guide shaft 8844. The guide shaft 8844 is a shaft which is disposed below the screw shaft 8841, and extends in the front-rear direction which is a moving direction of the nut portion 8842. The guide shaft 8844 penetrates the nut portion 8842 and the movable body 883, and is supported by the front plate 871 and the rear plate 872. Further, the nut portion 8842 is connected to the movable body 883 by the connecting shaft 8843.

In the blade moving portion 884, when the screw shaft 8841 rotates, the nut portion 8842 moves in the front-rear direction while being guided by the guide shaft 8844. When the nut portion 8842 moves, the movable body 883 which is connected to the nut portion 8842 by way of the connecting shaft 8843 moves in the front-rear direction. When the movable body 883 moves, the wiper blade 881 which is mounted on the movable body 883 moves in the front-rear direction while being brought into contact with the ink ejection surface 22S, and performs a cleaning operation of wiping the ink adhered to the ink ejection surface 22S. The wiper blade 881 after performing the cleaning operation applied to the head unit 21 returns to the retracted position which is retracted rearward from the head unit 21.

[Drive Mechanism of Pump]

As described above, the pump 8 can be driven in the forward and reverse rotational directions due to applying of a rotational drive force to the eccentric cam 81 when the pressurized purge mode, the circulation mode and the decompression mode are performed. As shown in FIG. 12, two driven shafts 84 are pivotally supported on the rack 203. In the carriage 2, the rack 203 is movable in the vertical direction together with the lower frame 201 and the upper frame 202, and forms a support portion for pivotally supporting the driven shaft 84. The driven shaft 84 is a shaft portion extending in the lateral direction, and is rotatably driven along with the rotation of the drive shaft 85 (FIG. 13) which is rotatably driven by a drive force from a drive motor 86 described later. A distal end portion (right end portion 84A) of the driven shaft 84 on a right side protrudes rightward from the rack 203. The driven shaft 84 has a transmission gear for transmitting a rotational drive force to the eccentric cam 81 of the pump 8. The pump 8 forms an operation mechanism which is operated by the rotation of the driven shaft 84.

The pressurized purge mode, the circulation mode, and the decompression mode are performed in a state where the carriage 2 is disposed in the maintenance area M shown in FIG. 3. In the maintenance area M, the previously-mentioned ink cartridge shelf 17 positioned above the carriage 2, and an end frame 18 positioned on a right side of the carriage 2 are disposed. The ink cartridge shelf 17 and the end frame 18 are fixedly mounted on the base frame 101. The end frame 18 is a frame formed of a flat plate extending in the vertical direction.

As shown in FIG. 12, two drive motors 86 for imparting a drive force to the pump 8 are mounted on the end frame 18. The drive motor 86 is a motor capable of generating a rotational drive force for the forward and reverse rotations. Further, two drive shafts 85 (FIG. 13) are pivotally supported on the end frame 18. The drive shaft 85 is a shaft portion extending in the lateral direction, and is rotatably driven by a drive force from the drive motor 86 serving as a drive source. A distal end portion (left end portion 85A) of the drive shaft 85 on a left side protrudes leftward from the end frame 18.

When the drive shaft 85 is rotatably driven by a drive force of the drive motor 86, a rotational drive force of the drive shaft 85 is transmitted to the driven shaft 84 so that the driven shaft 84 is rotatably driven. When the driven shaft 84 is rotatably driven, a rotational force of the driven shaft 84 is transmitted to the eccentric cam 81 by way of the transmission gear of the driven shaft 84. The cam shaft 83 is inserted into a shaft hole 81A of the eccentric cam 81, and the eccentric cam 81 rotates about the cam shaft 83 along with the rotation of the driven shaft 84 thus performing a pump operation.

In a state where the clip 35V is closed, when the eccentric cam 81 is driven by the forward rotation in a counterclockwise direction, the pump 8 feeds a pressurized ink to the head unit 21 for performing purge process (pressurized purge mode). Further, in a state where the supply valve 33V is closed and the clip 35V is opened, when the eccentric cam 81 is driven by the forward rotation in the counterclockwise direction, the pump 8 circulates, for the circulation process, the ink through the circulation path formed of the downstream bypass pipe BP2, the downstream pipe 34 on a downstream side of the joint part a, the common passage 27 in the head unit 21, the return pipe 35, and the upstream bypass pipe BP1. On the other hand, when the eccentric cam 81 is driven by the reverse rotation in a clockwise direction, the pump 8 decreases a pressure of the head unit 21 to a predetermined negative pressure for the decompression process (decompression mode).

[Joint Mechanism]

The printer 1 according to this embodiment includes the joint mechanism 9 shown in FIG. 12 as a mechanism for transmitting a rotational drive force of the drive shaft 85 to the driven shaft 84. The joint mechanism 9 is a mechanism where the drive shaft 85 and the driven shaft 84 coaxially connected to each other along the axial direction (lateral direction), and a rotational drive force of the drive shaft 85 is transmitted to the driven shaft 84. In the joint mechanism 9, the drive shaft 85 and the driven shaft 84 are coaxially connected to each other when the carriage 2 is moved rightward from the printing area P and is disposed in the maintenance area M. As described above, in the carriage 2 which is disposed in the maintenance area M, a body portion which includes the lower frame 201, the upper frame 202, and the rack 203 is movable in the vertical direction intersecting with the axial direction of the drive shaft 85 and the driven shaft 84. In the description made hereinafter, there may be a case where a state where the body portion of the carriage 2 moves in the vertical direction is referred to as "the carriage 2 moves in the vertical direction". In a case where the carriage 2 moves in the vertical direction, the head units 21 and the liquid supply units 3 mounted on the carriage 2, and the driven shaft 84 pivotally supported on the rack 203 are also moved in the vertical direction.

As shown in FIG. 12, the joint mechanism 9 includes: a first engaging portion 91 which is mounted on a right end portion 84A (first distal end portion; see FIG. 4) which is a distal end portion of the driven shaft 84; and a coupling 92 and a support pin 93 which are mounted on a left end portion 85A (second distal end portion; see FIG. 14) which is a distal end portion of the drive shaft 85. The first engaging portion 91 is formed of an engaging pin which is provided such that both ends of the engaging pin protrude outward in the radial direction from a peripheral surface of the driven shaft 84.

Figure 13:
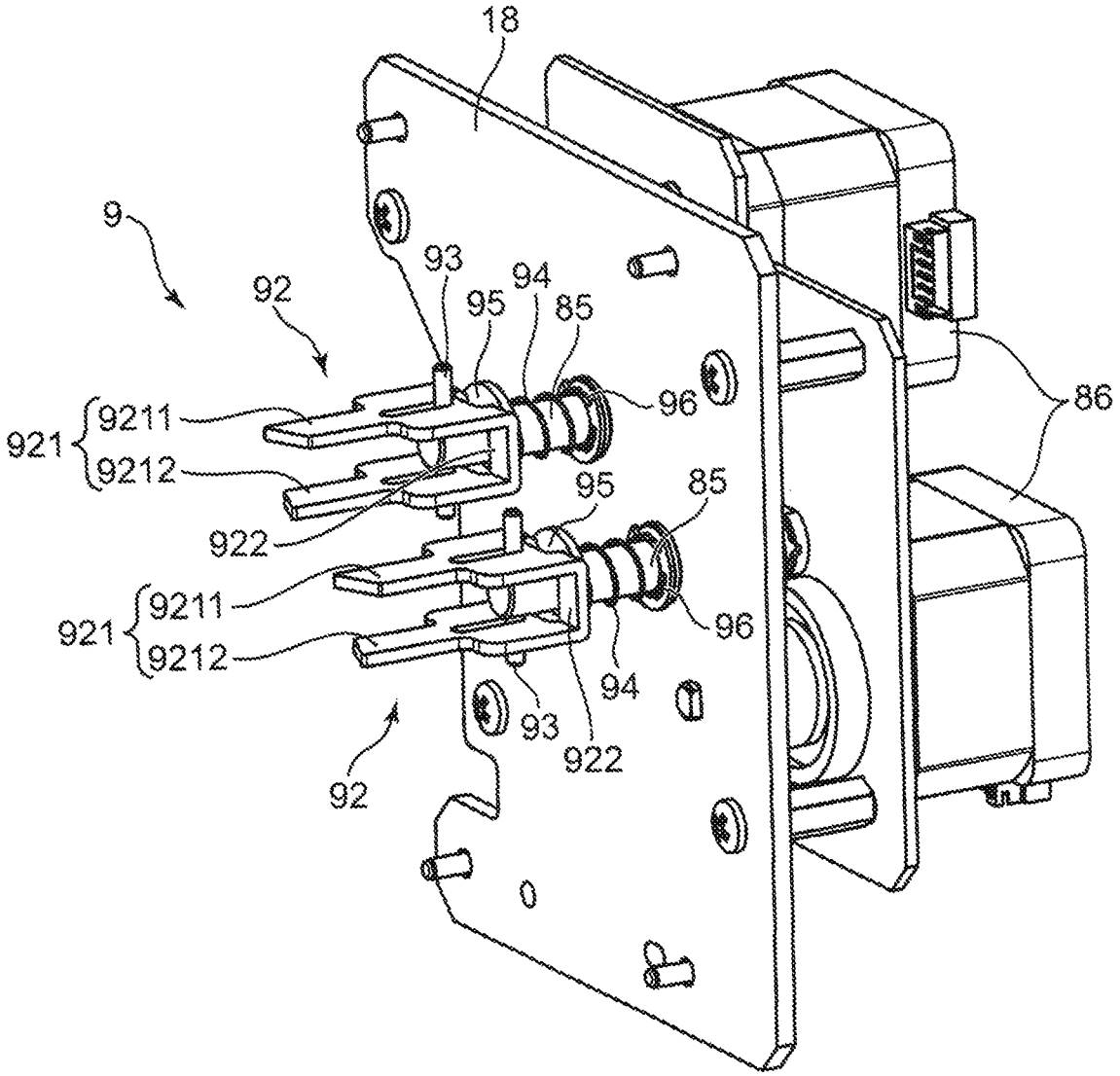
FIG. 13 is a perspective view showing a coupling of the joint mechanism and an area in the vicinity of the coupling in an enlarged manner.

FIG. 13 is a perspective view showing the coupling 92 of the joint mechanism 9 and an area in the vicinity of the coupling 92 in an enlarged manner. The coupling 92 includes a pair of engaging plates 9211, 9212, and a connecting portion 922. The pair of engaging plates 9211, 9212 are plate-like bodies disposed in a facing manner with a distance defined therebetween, and form a second engaging portion 921 which is engageable with the first engaging portion 91. The pair of engaging plates 9211, 9212 are engaged with the first engaging portion 91 in a state where the first engaging portion 91 is inserted between the pair of engaging plates 9211, 9212. In such an engagement state, the drive shaft 85 and the driven shaft 84 are coaxially connected to each other.

The connecting portion 922 is a portion for connecting one end portions of the pair of engaging plates 9211, 9212 to each other. The pair of engaging plates 9211, 9212 and the connecting portion 922 are formed as an integral body. The coupling 92 having such an integral structure is formed of a member made of sheet metal. It is unnecessary to form the sheet-metal-made coupling 92 by molding using a dedicated die, and the sheet-metal-made coupling 92 can be easily manufactured by applying working such as a bending to a sheet-metal-made member.

The coupling 92 is supported on the left end portion 85A of the drive shaft 85 such that the coupling 92 is swingable in the vertical direction intersecting with the axial direction (lateral direction) of the drive shaft 85 in a state where the pair of engaging plates 9211, 9212 (second engaging portion 921) is engaged with the first engaging portion 91. In a state where the pair of engaging plates 9211, 9212 is engaged with the first engaging portion 91, the connecting portion 922 becomes a pivot of the swinging of the coupling 92. In this manner, the coupling 92 is swingable in the vertical direction in a state where the coupling 92 is engaged with the first engaging portion 91. With such a configuration, in a state where the drive shaft 85 and the driven shaft 84 are connected to each other by the joint mechanism 9, the carriage 2 which pivotally supports the driven shaft 84 can be moved in the vertical direction. Accordingly, in a case where the carriage 2 is moved in the vertical direction, it is unnecessary to release the engagement between the first engaging portion 91 and the coupling 92 by moving the carriage 2 toward a direction away from the drive shaft 85 along the axial direction (lateral direction).

Figure 14:
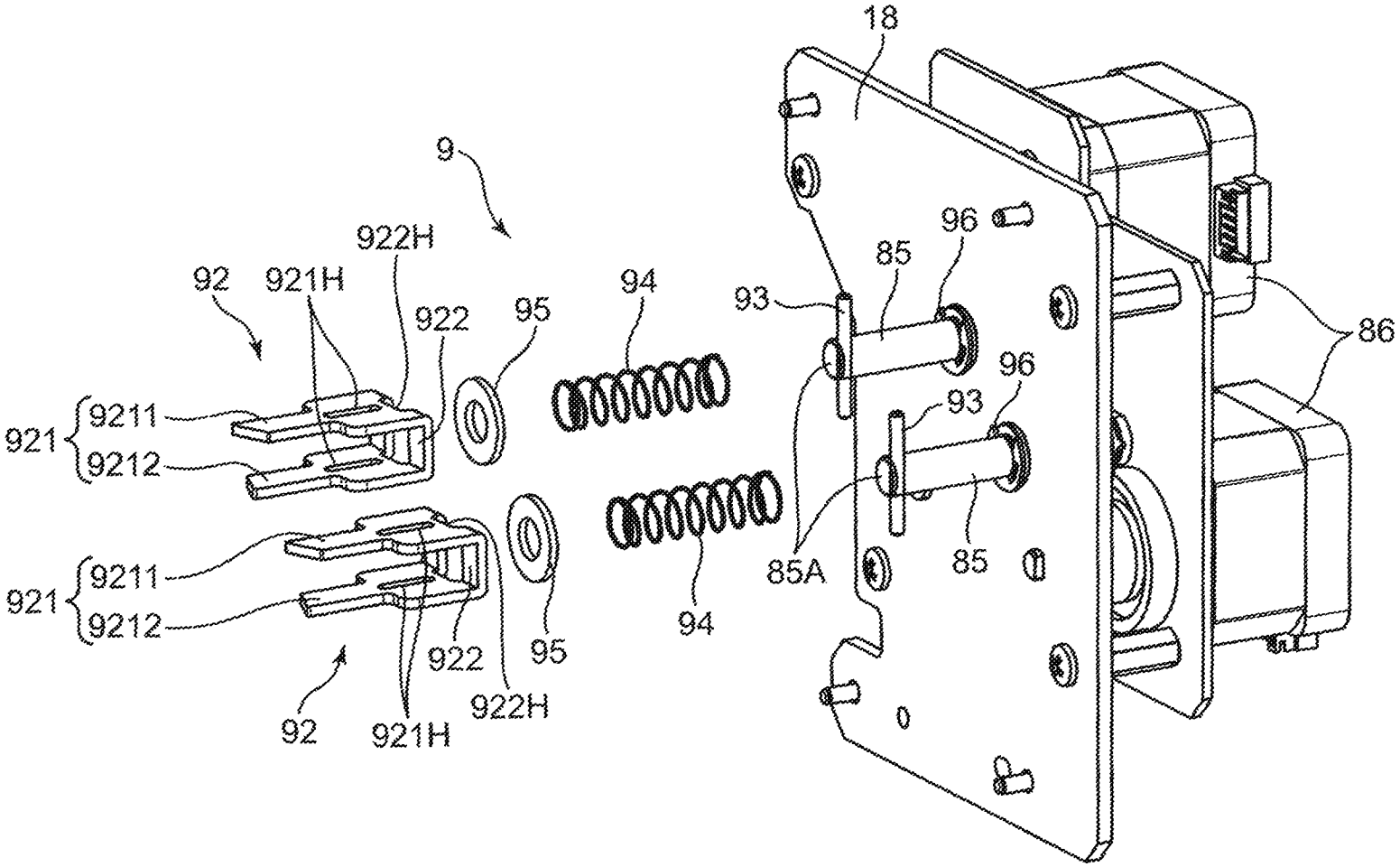
FIG. 14 is an exploded perspective view of the joint mechanism.
Figure 15:
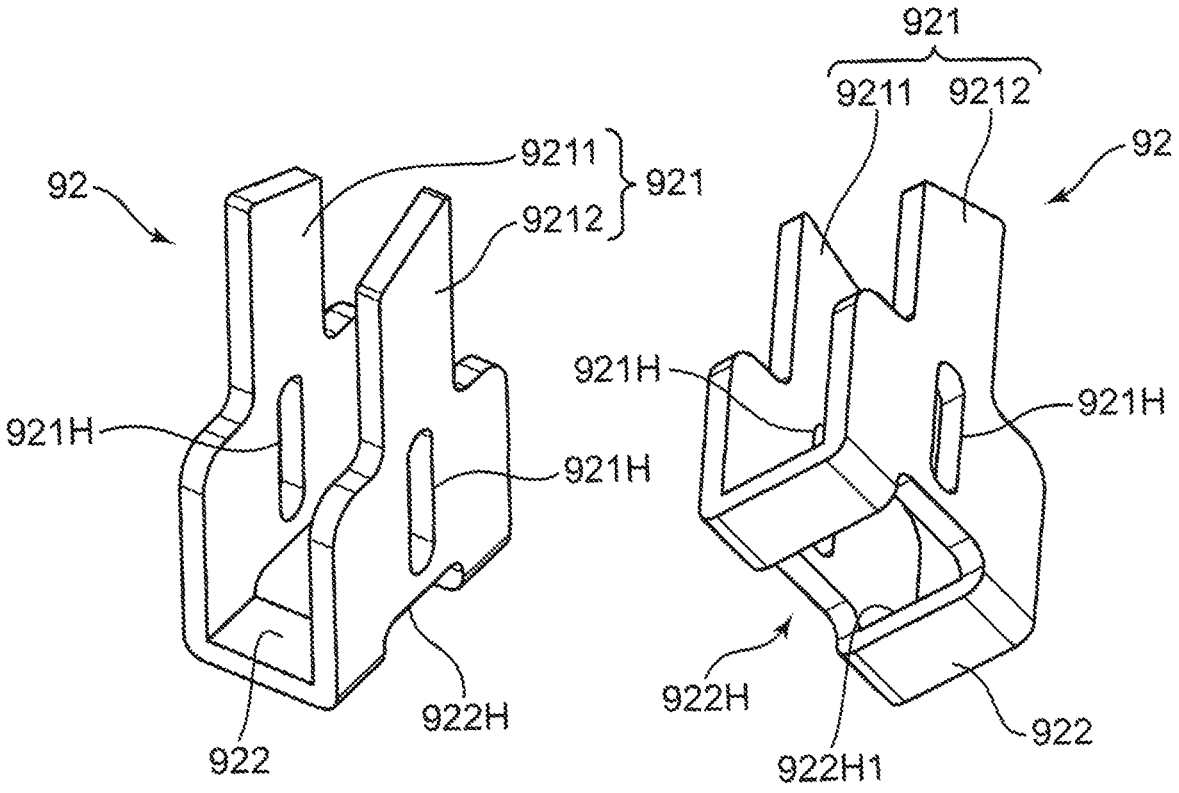
FIG. 15 is a perspective view of the coupling.
Figure 16A:
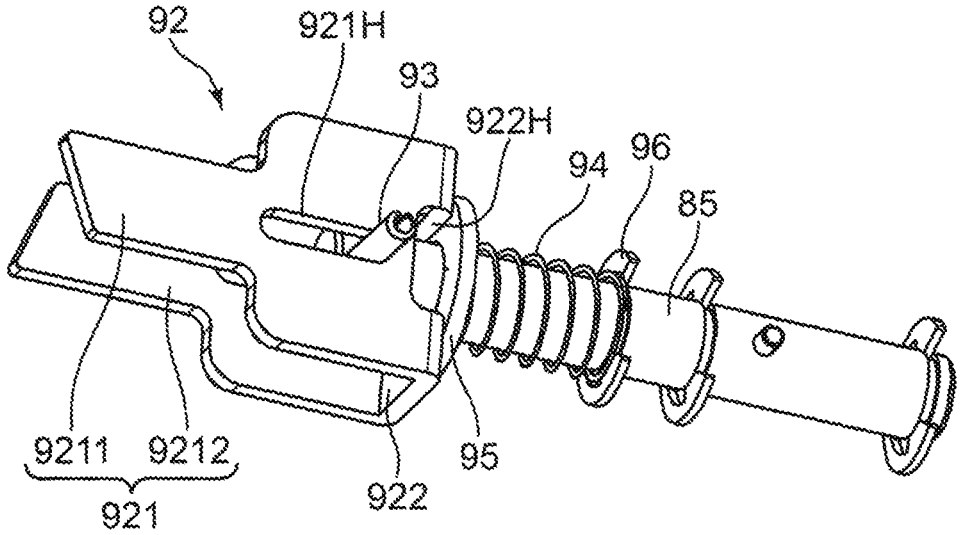
FIGS. 16A and 16B are perspective views showing a state where the coupling moves along the axial direction.
Figure 16B:
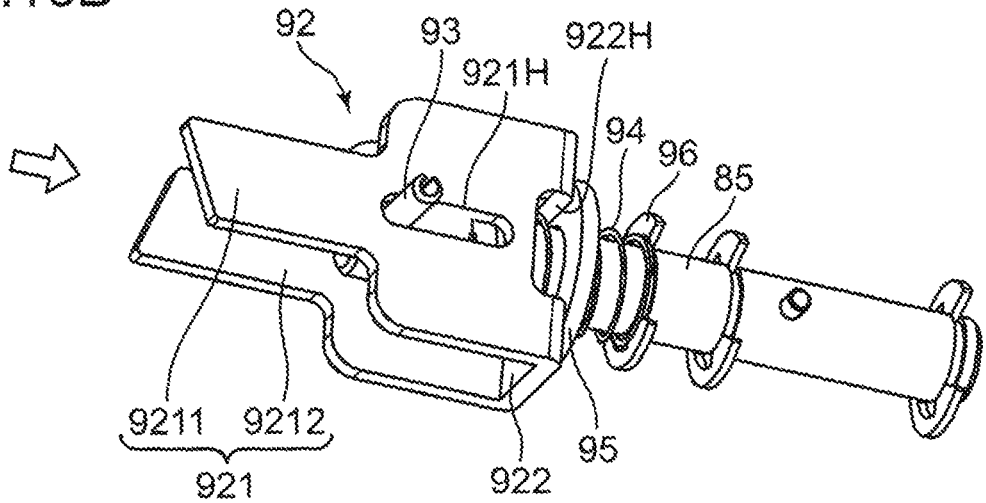
Figure 17A:
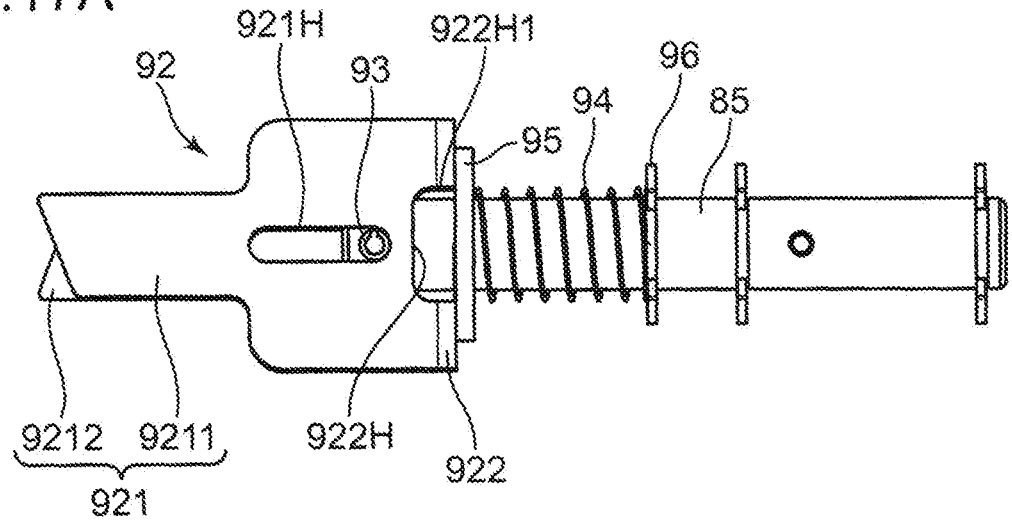
FIGS. 17A and 17B are views showing a swinging state of the coupling in a direction intersecting with axial direction.
Figure 17B:
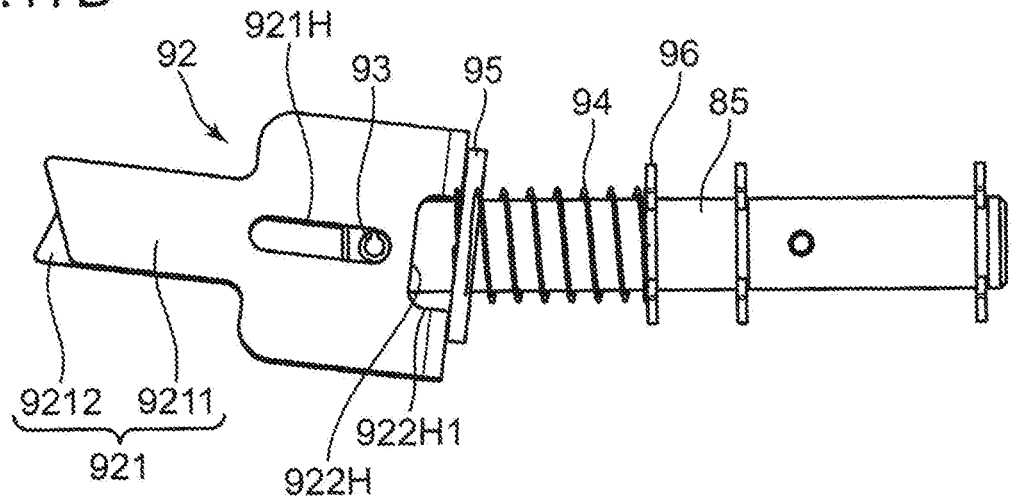

The more specific configuration of the coupling 92 is described with reference to FIG. 14 to FIG. 18 in addition to FIG. 13. FIG. 14 is an exploded perspective view of the joint mechanism 9, and FIG. 15 is a perspective view of the coupling 92. FIGS. 16A and 16B are perspective views showing a state where the coupling 92 moves along the axial direction. FIGS. 17A and 17B and FIGS. 18A and 18B are views showing a swinging state of the coupling 92 in the vertical direction.

The connecting portion 922 has an insertion opening 922H into which the left end portion 85A of the drive shaft 85 is inserted. In a state where the left end portion 85A of the drive shaft 85 is inserted into the insertion opening 922H, a gap is formed between an opening end edge 922H1 of the insertion opening 922H and the drive shaft 85.

One engaging plate 9211 and the other engaging plate 9212 are parallel to each other, and a distal end (left end) on a side opposite to a connecting portion with the connecting portion 922 of each engaging plate is inclined with respect to an imaginary plane perpendicular to the drive shaft 85. Inclination directions of respective left ends of the pair of engaging plate 9211, 9212 are opposite to each other. Each of the pair of engaging plates 9211, 9212 has a pin hole 921H into which the support pin 93 formed on the left end portion 85A of the drive shaft 85 is inserted. The pin hole 921H is formed in an elongated hole extending in the lateral direction along the axial direction of the drive shaft 85. The support pin 93 is a pin mounted on the left end portion 85A of the drive shaft 85, and both ends of the support pin 93 protrude outward in a radial direction from the peripheral surface of the drive shaft 85.

Figure 18A:
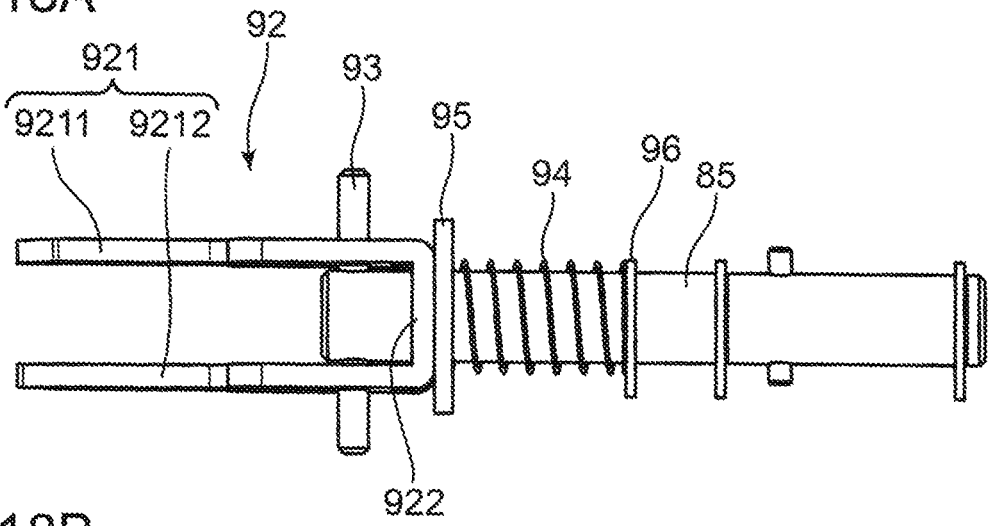
FIGS. 18A and 18B are views showing a swinging state of the coupling in a direction intersecting with the axial direction.
Figure 18B:
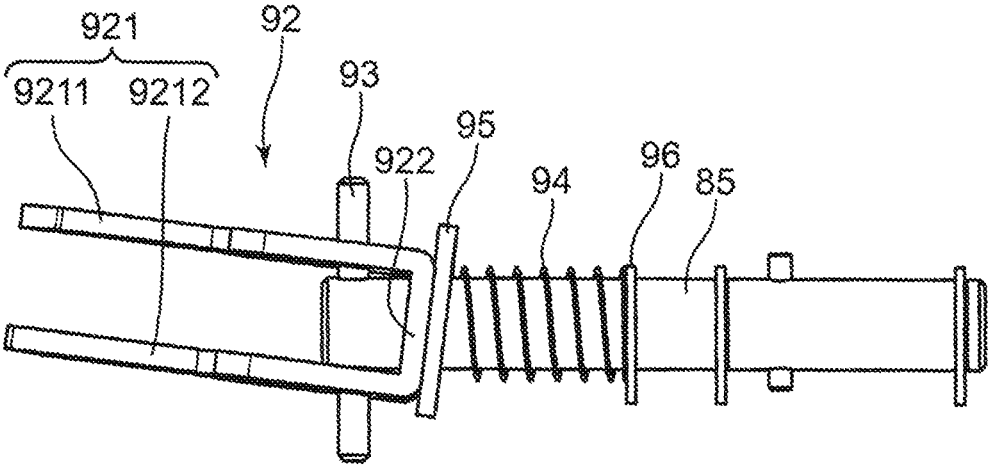

The coupling 92 is supported on the drive shaft 85 in a state where the left end portion 85A of the drive shaft 85 is inserted into the insertion opening 922H, and the support pin 93 is inserted into the pin hole 921H. The coupling 92 is swingable in the vertical direction using the support pin 93 as a fulcrum (FIG. 17A and FIG. 17B), and is swingable in the vertical direction using the connecting portion 922 in which the insertion opening 922H is formed as a pivot (FIG. 18A and FIG. 18B).

Further, a circular annular pressing member 95 is inserted into the left end portion 85A of the drive shaft 85 such that the pressing member 95 is brought into contact with a back surface (right surface) of the connecting portion 922 of the coupling 92, and a spring retainer member 96 is mounted on the left end portion 85A in a spaced-apart from the pressing member 95 rightward. Further, on the left end portion 85A of the drive shaft 85, a biasing spring member 94 formed of a coil spring is inserted into the left end portion 85A such that the biasing spring member 94 is disposed between the pressing member 95 and the spring retainer member 96. The biasing spring member 94 biases the pressing member 95 leftward along the drive shaft 85. The pressing member 95 presses the coupling 92 leftward due to a biasing force from the biasing spring member 94.

The coupling 92 is supported on the left end portion 85A of the drive shaft 85 in a movable manner along the axial direction between a first position shown in FIG. 16A and a second position shown in FIG. 16B by a biasing force of the biasing spring member 94. The first position is the position where the support pin 93 is brought into contact with a right end edge of the pin hole 921H due to a biasing force of the biasing spring member 94. The second position is a position where the support pin 93 is brought into contact with a left end edge of the pin hole 921H against the biasing force of the biasing spring member 94.

[Connection State Between Driven Shaft and Drive Shaft by Joint Mechanism]

Figure 19A:
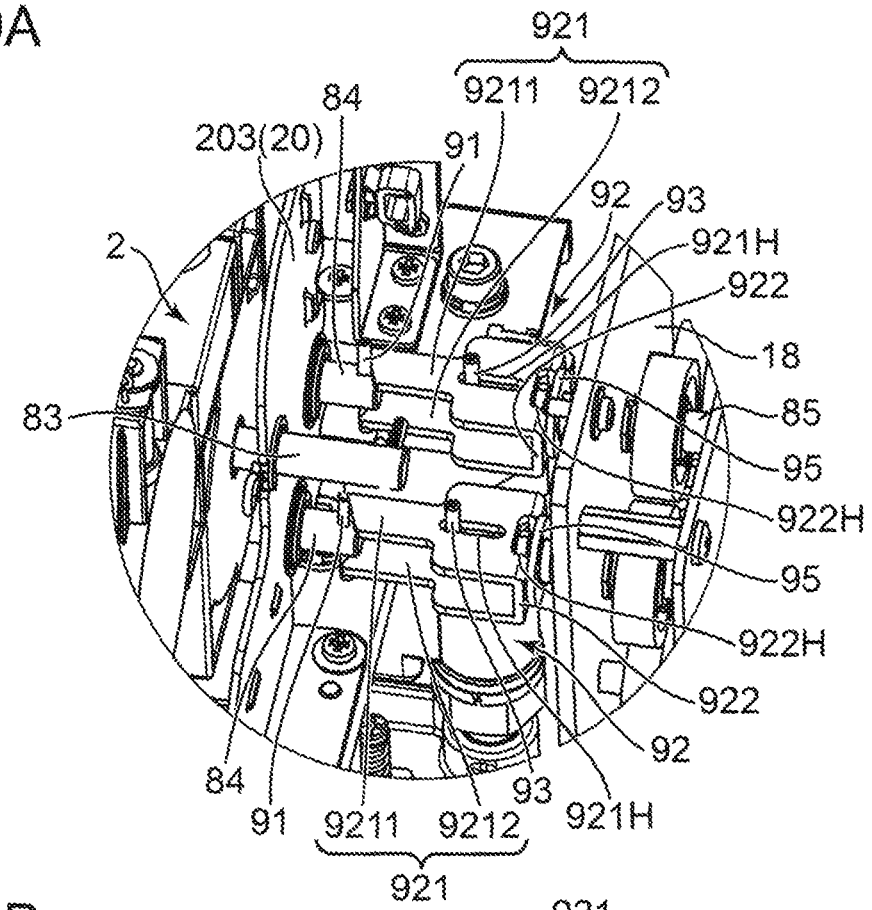
FIGS. 19A and 19B are perspective views showing a connection state between the driven shaft and the drive shaft by the joint mechanism.
Figure 19B:
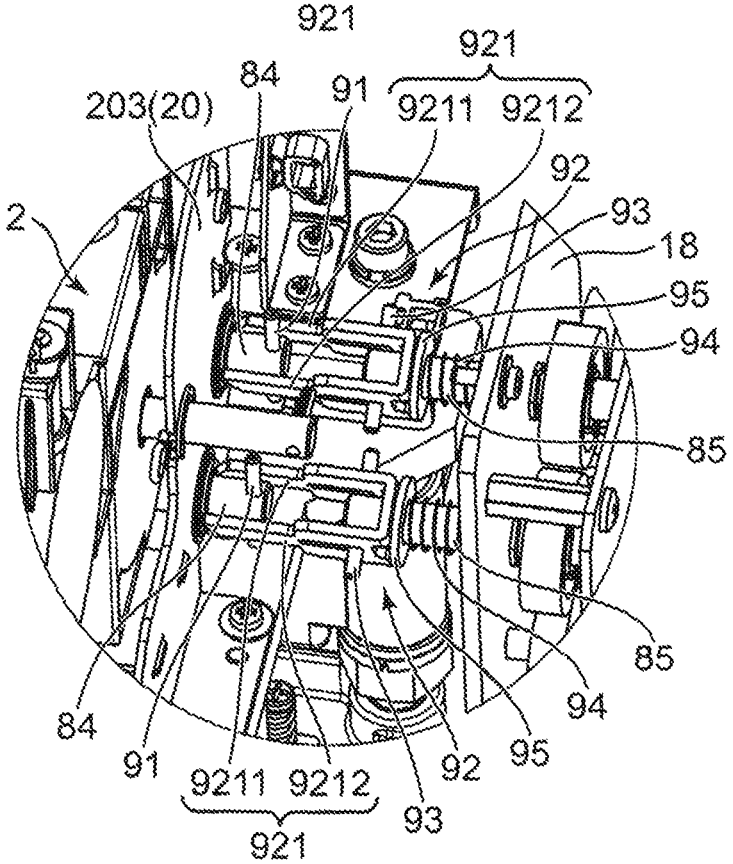
Figure 20:
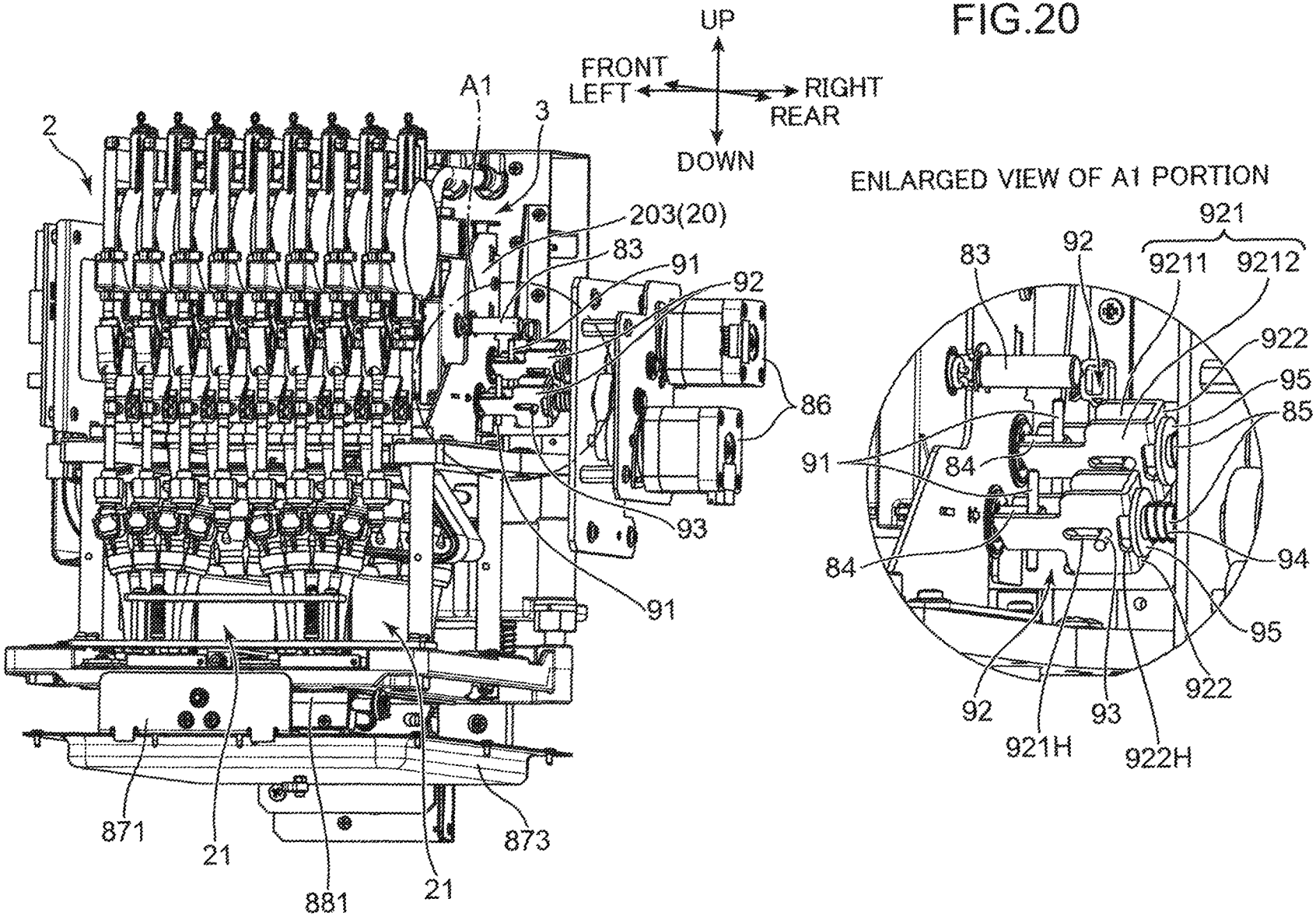
FIG. 20 is a perspective view showing a connection state between the driven shaft and the drive shaft by the joint mechanism in a state where the carriage is disposed in the maintenance area.
Figure 21:
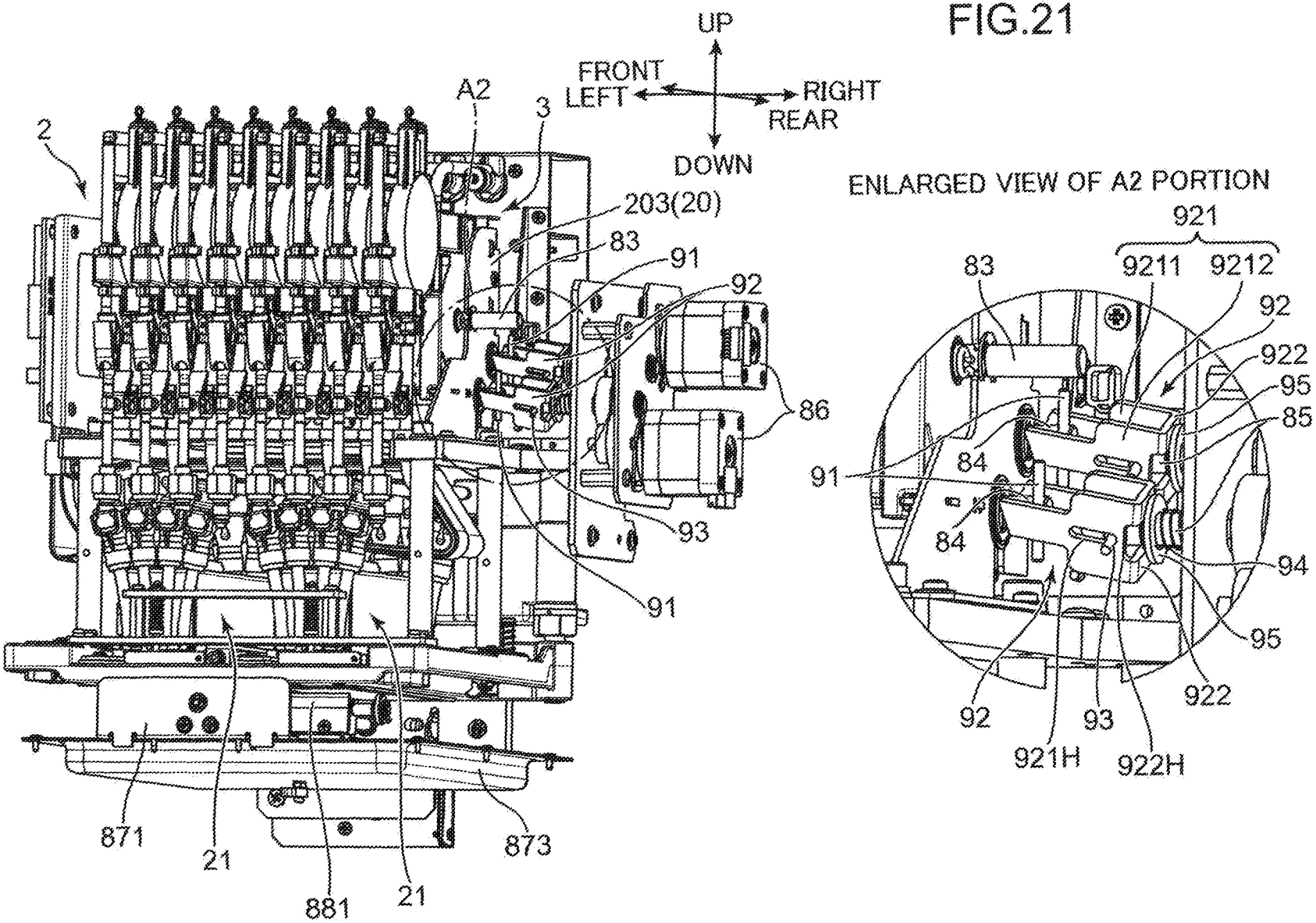
FIG. 21 is a perspective view showing a state where the carriage moves upward in a state where the driven shaft and the drive shaft are connected to each other by the joint mechanism.
Figure 22A:
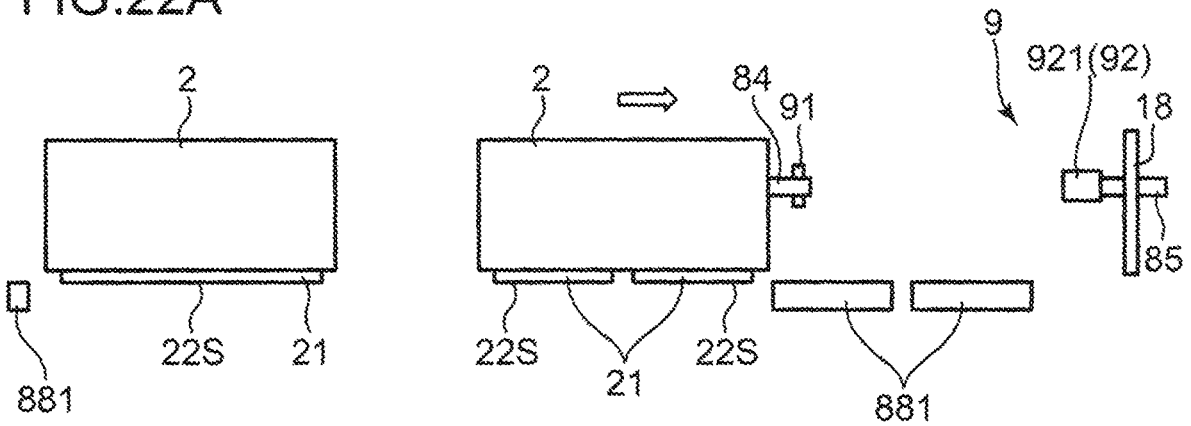
FIGS. 22A and 22B are views schematically showing a moving operation of the carriage for performing a pressurized purge mode.
Figure 22B:
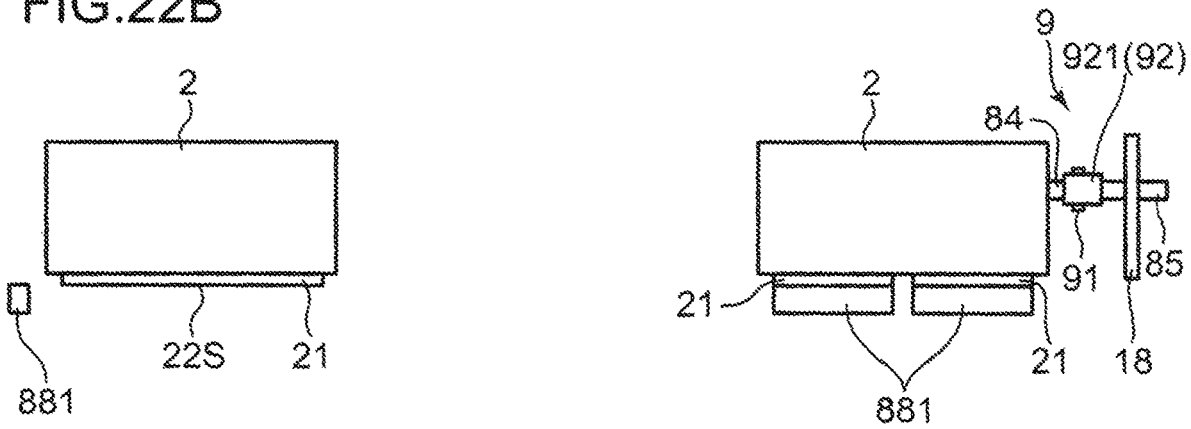
Figure 23A:
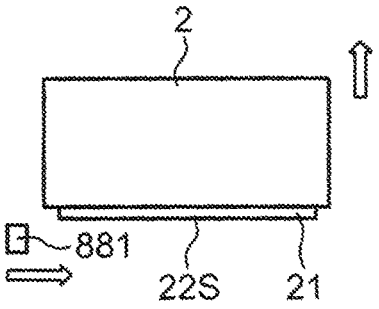
FIGS. 23A, 23B and 23C are views schematically showing a moving operation of the carriage for performing a cleaning operation by a wiper blade applied to the head unit.
Figure 23A:
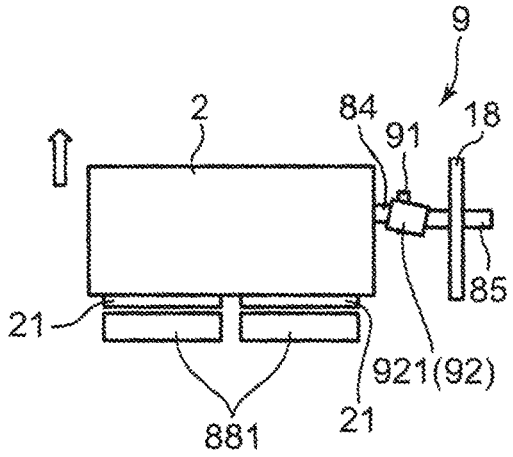
Figure 23B:
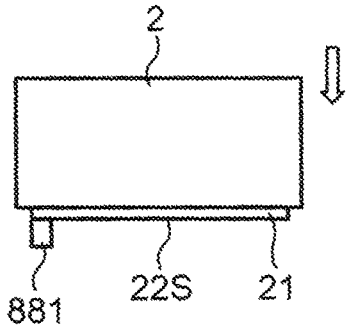
Figure 23B:
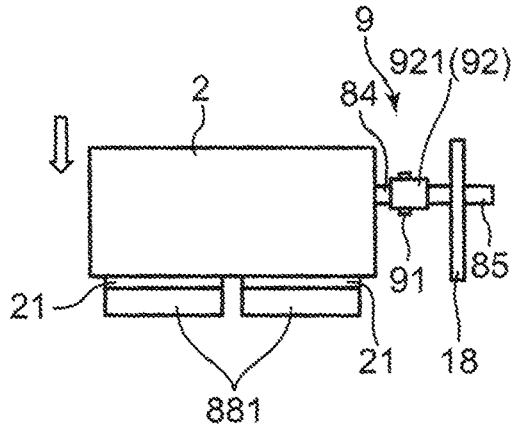
Figure 23C:
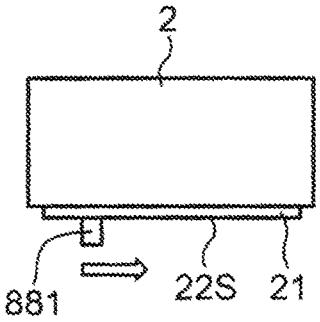
Figure 23C:
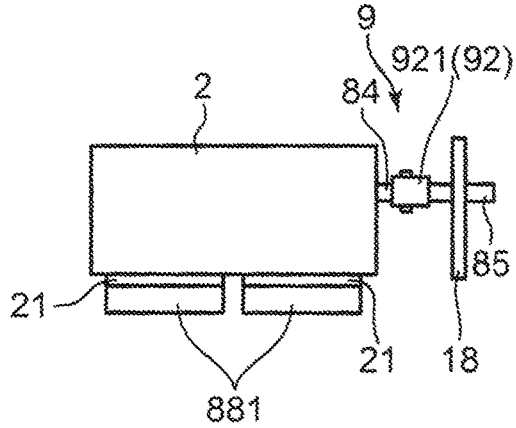
Figure 24A:
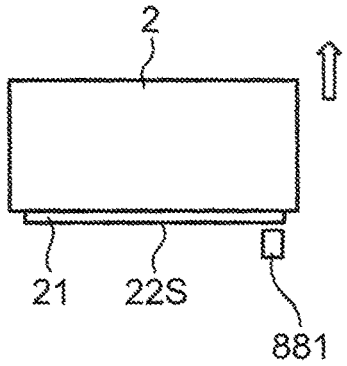
FIGS. 24A, 24B and 24C are views schematically showing a moving operation of the carriage after the cleaning operation by the wiper blade is performed.
Figure 24A:
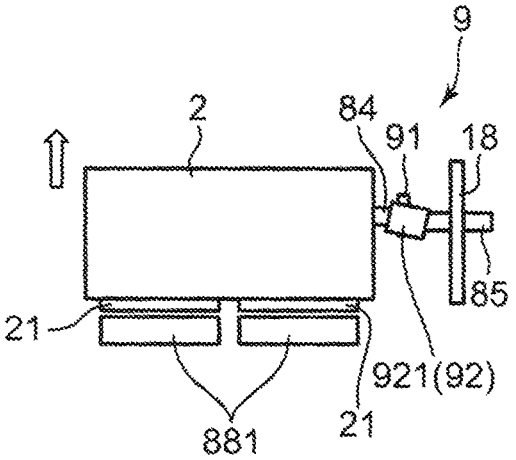
Figure 24B:
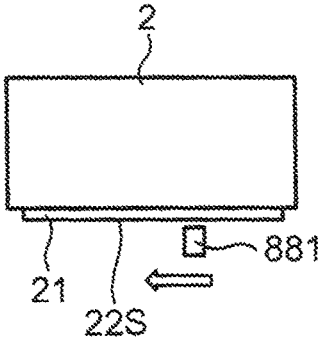
Figure 24B:
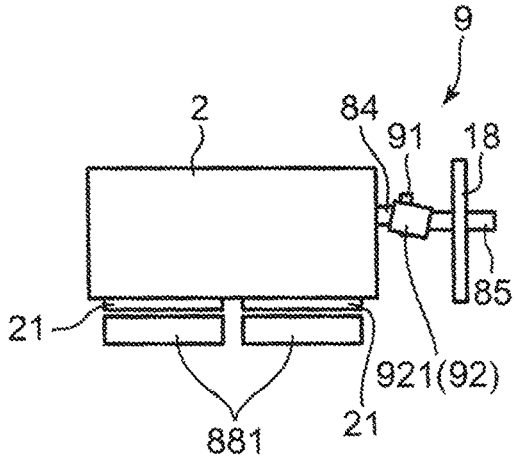
Figure 24C:
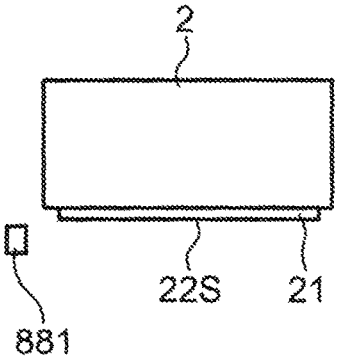
Figure 24C:
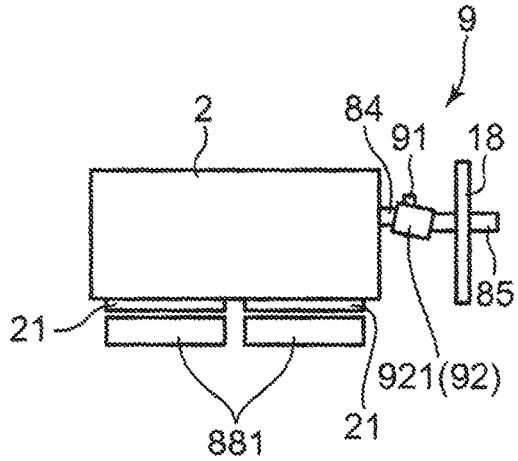
Figure 25A:
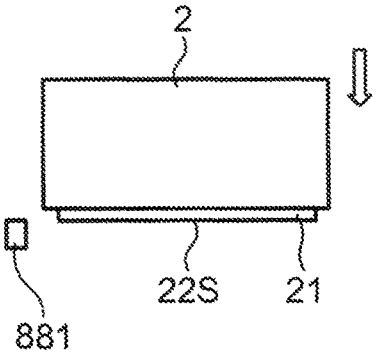
FIGS. 25A and 25B are views schematically showing the moving operation of the carriage for performing a decompression mode.
Figure 25A:
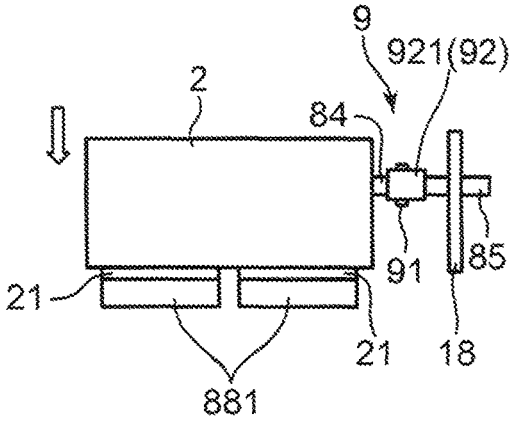
Figure 25B:
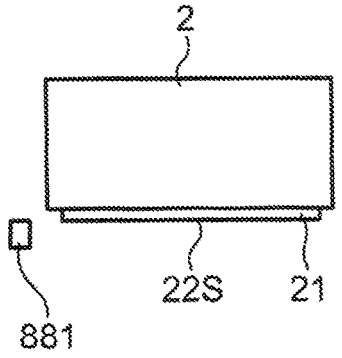
Figure 25B:
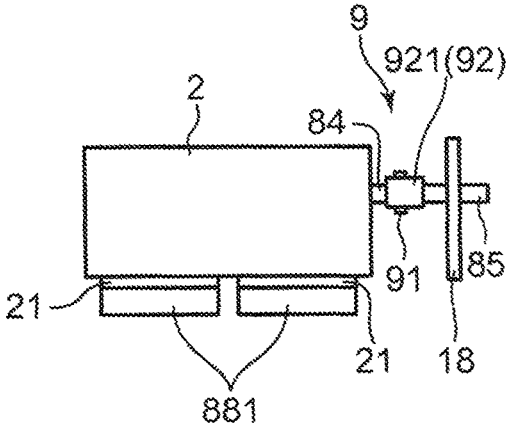

FIGS. 19A and 19B are perspective views showing a connection state between the driven shaft 84 and the drive shaft 85 by the joint mechanism 9. FIG. 20 is a perspective view showing a connection state between the driven shaft 84 and the drive shaft 85 by the joint mechanism 9 in a state where the carriage 2 is disposed in the maintenance area M. FIG. 21 is a perspective view showing a state where the carriage 2 moves upward in a state where the driven shaft 84 and the drive shaft 85 are connected to each other by the joint mechanism 9. FIGS. 22A and 22B are views schematically showing a moving operation of the carriage 2 for performing the pressurized purge mode. FIGS. 23A to 23C are views schematically showing a moving operation of the carriage 2 for performing the cleaning operation by the wiper blade 881 applied to the head unit 21. FIGS. 24A to 24C are views schematically showing a moving operation of the carriage 2 after the cleaning operation by the wiper blade 881 is performed. FIGS. 25A and 25B are views schematically showing the moving operation of the carriage 2 for performing the decompression mode.

As described above, in the joint mechanism 9, the drive shaft 85 and the driven shaft 84 are coaxially connected to each other when the carriage 2 is moved rightward from the printing area P and is arranged in the maintenance area M (see FIG. 22A and FIG. 22B). When the carriage 2 is arranged in the maintenance area M, the first engaging portion 91 disposed on the right end portion 84A of the driven shaft 84 is brought into contact with left ends of the pair of engaging plates 9211, 9212 of the coupling 92 mounted on the left end portion 85A of the drive shaft 85 (FIG. 19A). In such a state, the support pin 93 is brought into contact with the left end edge of the pin hole 921H against a biasing force of the biasing spring member 94, and the coupling 92 is arranged at the second position.

In a state where the coupling 92 is arranged at the second position, when the drive shaft 85 is rotatably driven by the forward rotational driving of the drive motor 86, the coupling 92 also rotates along with the rotation of the drive shaft 85. When the coupling 92 rotates, the contact state between the left ends of the pair of engaging plates 9211, 9212 and the first engaging portion 91 is released. When the contact state is released, the support pin 93 is brought into contact with the right end edge of the pin hole 921H due to a biasing force of the biasing spring member 94, and the coupling 92 is arranged at the first position (FIG. 19B). In such a state, the pair of engaging plates 9211, 9212 and the first engaging portion 91 are engaged with each other so that the drive shaft 85 and the driven shaft 84 are coaxially connected to each other.

When the drive shaft 85 and the driven shaft 84 are connected to each other by the joint mechanism 9, the driven shaft 84 is rotatably driven in an interlocking manner with the rotation of the drive shaft 85 (FIG. 20). When the driven shaft 84 is rotated, the pump 8 of the liquid supply unit 3 is operated so that the pressurized purge mode is performed (see FIG. 22B).

After the pressurized purge mode is performed, driving of the drive motor 86 is stopped, and the rotation of the drive shaft 85 and the rotation of the driven shaft 84 are stopped. When the driving of the drive motor 86 is stopped, the carriage 2 moves upward (see FIG. 23A). When the carriage 2 moves upward, the driven shaft 84 also moves upward along with the movement of the carriage 2. When the driven shaft 84 moves upward, the coupling 92 swings upward while holding the engagement state between the pair of engaging plates 9211, 9212 and the first engaging portion 91 (see FIG. 21, FIG. 23A). Accordingly, in a case where the carriage 2 is moved upward, it is unnecessary to release the engagement between the first engaging portion 91 and the coupling 92 by moving the carriage 2 toward a direction away from the drive shaft 85 along the axial direction.

When the carriage 2 moves upward to a predetermined position, the upward movement of the carriage 2 is stopped. In such a state, the wiper blade 881 which is arranged at the retracted position behind the head unit 21 moves to a cleaning start position where the wiper blade 881 can be brought into contact with the ink ejection surface 22S of the head unit 21 (see FIG. 23A). When the wiper blade 881 is arranged at the cleaning start position, the carriage 2 moves downward, and at a point of time where the driven shaft 84 is disposed at the position equal to the height position of the drive shaft 85, the downward movement of the carriage 2 is stopped (see FIG. 23B). In such a state, the connection between the driven shaft 84 and the drive shaft 85 coaxially by the joint mechanism 9 is maintained, and the wiper blade 881 is brought into contact with the ink ejection surface 22S.

When the downward movement of the carriage 2 is stopped, the wiper blade 881 wipes the ink adhered to the ink ejection surface 22S by moving frontward while being brought into contact with the ink ejection surface 22S (see FIG. 23C).

When the cleaning operation by the wiper blade 881 applied to the head unit 21 is completed, the carriage 2 moves upward (see FIG. 24A). When the carriage 2 moves upward, the driven shaft 84 also moves upward along with the movement of the carriage 2. When the driven shaft 84 moves upward, the coupling 92 swings upward while holding the engagement state between the pair of engaging plates 9211, 9212 and the first engaging portion 91 (see FIG. 24A).

When the carriage 2 moves upward to a predetermined position, the upward movement of the carriage 2 is stopped. In such a state, the contact state between the wiper blade 881 with the ink ejection surface 22S is released. The wiper blade 881 moves rearward (FIG. 24B), and is stopped at the retracted position (FIG. 24C).

When the wiper blade 881 is arranged at the retracted position, the carriage 2 moves downward, and at a point of time where the driven shaft 84 is disposed at the position equal to the height position of the drive shaft 85, the downward movement of the carriage 2 is stopped (see FIG. 25A). In such a state, the connection between the driven shaft 84 and the drive shaft 85 coaxially by the joint mechanism 9 is maintained. In such a state, a reverse rotation drive of the drive motor 86 is started. When the drive shaft 85 is rotatably driven by a reverse rotation drive of the drive motor 86, the driven shaft 84 which is connected by the joint mechanism 9 is rotatably driven. When the driven shaft 84 is rotated, the pump 8 of the liquid supply unit 3 is operated so that the decompression mode is performed (see FIG. 25B). When the decompression mode is performed after the pressurized purge mode is performed, the ink ejecting portion 22 and the second chamber 42 can be set to a predetermined negative pressure. With such an operation, a state is brought about where the printing mode can be performed.

According to the embodiment of the present invention which has been described heretofore, it is possible to provide the joint mechanism 9 which enables the movement of the carriage 2 (movable body) in a direction intersecting with the axial direction in a state where the drive shaft 85 and the driven shaft 84 are coaxially connected to each other, and the printer 1 (liquid ejection device) which includes such a joint mechanism 9.

In the above-mentioned embodiment, the description is made by taking a case where the first engaging portion 91 is mounted on the right end portion 84A (first distal end portion) of the driven shaft 84, and the coupling 92 having the second engaging portion 921 is mounted on the left end portion 85A (second distal end portion) of the drive shaft 85 as an example. Instead of the above-mentioned configuration, the coupling 92 having the second engaging portion 921 may be mounted on the right end portion 84A of the driven shaft 84, and the first engaging portion 91 may be mounted on the left end portion 85A of the drive shaft 85.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A joint mechanism where a drive shaft rotatably driven by a drive force from a drive source and a driven shaft pivotally supported on a movable body, the drive shaft and the driven shaft being coaxially connected to each other along an axial direction, so that a rotational drive force of the drive shaft is transmitted to the driven shaft, the driven shaft having a first distal end portion and the drive shaft having a second distal end portion, the joint mechanism comprising:

a first engaging portion that includes an engaging pin having opposite first and second ends that protrude outward in a radial direction from a peripheral surface of the first distal end portion of the driven shaft;

a coupling having first and second engaging plates arranged in a facing manner with a distance therebetween and being formed respectively with first and second pin holes, the coupling further having a connecting portion that connects the first and second engaging plates to each other, the connecting portion having an insertion opening into which the second distal end portion of the drive shaft is inserted with a gap being formed between an opening end edge of the insertion opening and the drive shaft to define a second engaging portion, that is engageable with the first engaging portion, the connecting portion being swingable in a direction intersecting with the axial direction in a state where the second engaging portion is engaged with the first engaging portion; and a support pin mounted on the second distal end portion of the drive shaft and having opposite first and second ends protruding outward in a radial direction from a peripheral surface of the drive shaft, wherein the coupling is supported on the drive shaft with the second distal end portion of the drive shaft inserted into the insertion opening, and the first and second support pins inserted respectively into the first and second pin holes in the respective first and second engaging plates of the coupling.

2. The joint mechanism according to claim 1, wherein the coupling is formed of a member made of sheet metal.

3. A liquid ejection device comprising:

a drive shaft which is rotatably driven by a drive force from a drive source;

a movable body which has a support portion which pivotally supports a driven shaft rotatably driven corresponding to the rotation of the drive shaft, and is movable in a direction intersecting with an axial direction of the drive shaft;

an operation mechanism which is mounted on the movable body and is operated by the rotation of the driven shaft;

a head unit which is mounted on the movable body and is capable of ejecting a predetermined liquid corresponding to an operation of the operation mechanism; and the joint mechanism, according to claim 1, where the drive shaft and the driven shaft are coaxially connected to each other along the axial direction.

* * * * *